US011633023B2

(12) United States Patent
Paikin

(10) Patent No.: US 11,633,023 B2
(45) Date of Patent: Apr. 25, 2023

(54) GEMSTONE AND METHODS OF CUTTING THE SAME

(71) Applicant: Albert Gad Ltd., New York, NY (US)

(72) Inventor: Reuven Paikin, Windhoek (NA)

(73) Assignee: ALBERT GAD LTD., New York, NY (US)

( * ) Notice: Subject to any disclaimer, the term of this patent is extended or adjusted under 35 U.S.C. 154(b) by 183 days.

(21) Appl. No.: 17/150,580

(22) Filed: Jan. 15, 2021

(65) Prior Publication Data

US 2021/0212422 A1 Jul. 15, 2021

Related U.S. Application Data

(60) Provisional application No. 62/961,607, filed on Jan. 15, 2020.

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/001
USPC ..... 63/32; D11/90
See application file for complete search history.

(56) References Cited

U.S. PATENT DOCUMENTS

| | | | | |
|---|---|---|---|---|
| 693,084 | A | 2/1902 | Townsend | |
| D481,649 | S * | 11/2003 | Samuels | D11/90 |
| 6,761,044 | B2 | 7/2004 | Samuels | |
| 8,156,760 | B2 | 4/2012 | Gad | |
| 2003/0181147 | A1 | 9/2003 | Schachter | |
| 2003/0192346 | A1 | 10/2003 | Samuels | |
| 2005/0000405 | A1 | 1/2005 | Brookshire | |
| 2011/0265514 | A1 * | 11/2011 | Fakier | A44C 17/001 63/3 |
| 2012/0060557 | A1 | 3/2012 | Van Looveren | |

* cited by examiner

*Primary Examiner* — Jack W Lavinder
(74) *Attorney, Agent, or Firm* — Nixon Peabody LLP

(57) ABSTRACT

A gemstone includes a crown, a pavilion, and a girdle disposed between the crown and the pavilion. The girdle has an elliptical cross-section with a major axis and a minor axis. The surface of the gemstone is generally divided into a number of groups of interlocking facets disposed at a variety of angles. The groups of facets comprising the surface of the crown generally include star facets, upper intermediate crown facets, lower intermediate crown facets, main crown facets, and upper girdle facets. The upper girdle facets generally abut an upper edge of the girdle. The groups of facets comprising the surface of the pavilion include culet-adjacent facets, candle facets, main pavilion facets, and lower girdle facets. The lower girdle facets generally abut a lower edge of the girdle.

26 Claims, 11 Drawing Sheets

GEMSTONE AND METHODS OF CUTTING THE SAME

CROSS-REFERENCE TO RELATED APPLICATIONS

The present application claims the benefit of and priority to U.S. Provisional Patent Application No. 62/961,607, filed Jan. 15, 2020, which is hereby incorporated by reference herein in its entirety.

TECHNICAL FIELD

The present disclosure relates to gemstones, more specifically, the present disclosure relates to a pattern of facets of gemstones.

BACKGROUND

Some gemstones are designed/cut to produce a desirable amount of brilliance, or "sparkle" by forming or cutting a number of individual facets on the exterior surface of the gemstone. Other gemstones are designed/cut to enhance a natural color (e.g., yellow, pink, etc.) of the gemstone. However, it can be difficult to produce a gemstone having a layout of facets at specific angles that produce both a desirable amount of brilliance and also enhance the natural color of the gemstone.

The present disclosure is directed to solving these problems and addressing other needs.

SUMMARY

According to some implementations of the present disclosure, a gemstone comprises a girdle, a crown, and a pavilion. The girdle defines a perimeter of the gemstone and has a cushion-shaped cross-section with a major axis and a minor axis, the major axis being larger than the minor axis. The crown forms an upper portion of the gemstone. A surface of the crown includes: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets, the plurality of main crown facets including a plurality of major main crown facets and a plurality of minor main crown facets, the plurality of major main crown facets being aligned along the major axis, the plurality of minor main crown facets being aligned along the minor axis; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets. The pavilion forms a lower portion of the gemstone. A surface of the pavilion includes a plurality of culet-adjacent facets forming a lower point of the pavilion, the plurality of culet-adjacent facets including a plurality of major culet-adjacent facets and a plurality of minor culet-adjacent facets, the plurality of major culet-adjacent facets being aligned along the major axis, the plurality of minor culet-adjacent facets being aligned along the minor axis; a plurality of candle facets, a lower portion of each of the plurality of candle facets being disposed generally between two of the plurality of culet-adjacent facets; a plurality of main pavilion facets, each of the main pavilion facets being disposed between two of the plurality of candle facets, a lower edge of each of the plurality of main pavilion facets abutting an upper edge of one of the plurality of culet-adjacent facets, the plurality of main pavilion facets including a plurality of major main pavilion facets and a plurality of minor main pavilion facets, the plurality of major main pavilion facets being aligned along the major axis, the plurality of minor main pavilion facets being aligned along the minor axis; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween. Each of the plurality of upper girdle facets is disposed adjacent to and abuts an upper edge of the girdle. Each of the plurality of lower girdle facets is disposed adjacent to and abuts a lower edge of the girdle.

According to some implementations of the present disclosure, a gemstone comprises a girdle and crown. The girdle forms a perimeter of the gemstone and has a cushion-shaped cross-section. The crown forms an upper portion of the gemstone. The surface of the crown includes a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets.

According to some implementations of the present disclosure, a gemstone comprises a girdle and a pavilion. The girdle forms a perimeter of the gemstone and has a cushion-shaped cross-section. The pavilion forms a lower portion of the gemstone. A surface of the pavilion includes a plurality of culet-adjacent facets forming a lower point of the pavilion; a plurality of candle facets, a lower portion of each of the plurality of candle facets being disposed generally between two of the plurality of culet-adjacent facets; a plurality of main pavilion facets, each of the plurality of main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween.

According to some implementations of the present disclosure, a gemstone comprises a girdle, a crown, and a pavilion. The girdle forms a perimeter of the gemstone and has a cushion-shaped cross-section. The crown forms an upper portion of the gemstone. A surface of the crown includes a table forming a generally horizontal upper surface of the crown, the table having a generally octagonal shape; a plurality of star facets disposed adjacent to the table, each of the plurality of star facets being triangle-shaped; a plurality of upper intermediate crown facets disposed adjacent to the plurality of star facets, each of the plurality of upper intermediate crown facets being kite-shaped; a plurality of lower intermediate crown facets disposed adjacent to the plurality of upper intermediate crown facets, each of the plurality of lower intermediate crown facets being kite-shaped; a plurality of main crown facets disposed adjacent to the plurality of lower intermediate crown facets, each of the plurality of main crown facets being kite-shaped; and a plurality of upper girdle facets disposed adjacent to the plurality of main crown facets, each of the plurality of upper girdle facets being triangle-shaped. The pavilion forms a lower portion of the gemstone. A surface of the pavilion includes a plurality of culet-adjacent facets forming a lower point of the pavilion, each of the plurality of culet-adjacent facets having a generally pentagonal shape; a plurality of candle facets disposed adjacent to the plurality of culet-adjacent facets, each of the plurality of candle facets having six edges; a plurality of main pavilion facets, each of the main pavilion facets being disposed between two of the plurality of candle facets and being pentagon-shaped; and a plurality of lower girdle facets formed in pairs of adjacent lower girdle facets, each pair of adjacent lower girdle facets being disposed generally between two of the plurality of main pavilion facets, each lower girdle facet having four edges. The girdle is positioned between the crown and the pavilion. Each of the plurality of upper girdle facets is disposed adjacent to and abuts an upper edge of the girdle. Each of the plurality of lower girdle facets is disposed adjacent to and abuts a lower edge of the girdle.

According to some implementations of the present disclosure, a gemstone comprises a crown, a pavilion, and a girdle. The crown forms an upper portion of the gemstone. The pavilion forms a lower portion of the gemstone. The girdle is positioned between the crown and the pavilion, and encircles the gemstone. The girdle has a cushion-shaped cross-section with a major axis and a minor axis, the major axis being larger than the minor axis. The gemstone has a top depth percentage between about 15% and about 35%, and a bottom depth percentage between about 45% and about 60%.

According to some implementations of the present disclosure, a gemstone comprises a crown, a pavilion, and a girdle. The crown forms an upper portion of the gemstone. The pavilion forms a lower portion of the gemstone. The girdle is positioned between the crown and the pavilion, and encircles the gemstone. The girdle has a cushion-shaped cross-section with a major axis and a minor axis, the major axis being larger than the minor axis. The gemstone has a total depth percentage between about 75% and about 95%.

According to some implementations of the present disclosure, a gemstone comprises a crown forming an upper portion of the gemstone and a pavilion forming a lower portion of the gemstone. The surface of the crown is defined by a first plurality of facets, each of the first plurality of facets being disposed at an angle between about 5° and about 60° relative to an upper surface of the gemstone. The surface of the pavilion is defined by a second plurality of facets, each of the second plurality of facets being disposed at an angle between about 25° and about 60° relative to the upper surface of the gemstone.

According to some implementations of the present disclosure, a method of forming a crown of a gemstone comprises forming a generally horizontal upper surface on an upper portion of the gemstone; forming a first temporary set of crown facets and a second temporary set of crown facets on the upper portion of the gemstone, the first temporary set of crown facets being formed at an angle of between about 37° and about 45° relative to the first preliminary table, the second temporary set of crown facets being formed at an angle of between about 42° and about 49° relative to the first preliminary table; forming a third temporary set of crown facets on the upper portion of the gemstone from portions of the generally horizontal upper surface, the first temporary set of crown facets, and the second temporary set of crown facets, the third temporary set of crown facets being formed at an angle of between about 25° and about 35° relative to the generally horizontal upper surface, a remainder of the first temporary set of crown facets forming a fourth temporary set of crown facets, a remainder of the second temporary set of crown facets forming a fifth temporary set of crown facets; forming a sixth temporary set of crown facets on the upper portion of the gemstone from portions of the generally horizontal upper surface and the third temporary set of crown facets, the sixth temporary set of crown facets being formed at an angle of between about 15° and about 24° relative to the generally horizontal upper surface, a remainder of the third temporary set of crown facets forming a first final set of crown facets; forming a second final set of crown facets on the upper portion of the gemstone from portions of the fourth temporary set of crown facets and the fifth temporary set of crown facets, the second final set of crown facets being formed at an angle of between about 42.5° and about 57° relative to the generally horizontal upper surface, a remainder of the fourth temporary set of crown facets forming a third final set of crown facets, a remainder of the fifth temporary set of crown facets forming a fourth final set of crown facets; and forming a fifth final set of crown facets on the upper portion of the gemstone from portions of the generally horizontal surface and the sixth temporary set of crown facets, the fifth final set of crown facets being formed at an angle of between about 10° and about 17° relative to the generally horizontal upper surface, a remainder of the sixth temporary set of crown facets forming a sixth final set of crown facets, such that the upper portion of the gemstone is formed from the first, second, third, fourth, fifth, and sixth final sets of crown facets.

According to some implementations of the present disclosure, a method of forming a pavilion of a gemstone having a horizontal upper surface comprises forming a first temporary set of pavilion facets, a second temporary set of pavilion facets, and a flat lower facet on a lower portion of the gemstone, the first temporary set of pavilion facets being formed at an angle of between about 41° and about 45° relative to the horizontal upper surface, the second temporary set of pavilion facets being formed at an angle of between about 45° and about 49° relative to the horizontal upper surface; forming a third temporary set of pavilion facets and a fourth temporary set of pavilion facets on the lower portion of the gemstone, the third temporary set of pavilion facets being formed from the first temporary set of pavilion facets and the flat lower facet, and being formed at an angle of between about 32° and about 38° relative to the horizontal upper surface, the fourth temporary set of pavilion facets being formed from the second temporary set of pavilion facets and the flat lower facet, and being formed at an angle of between about 36° and about 42° relative to the horizontal upper surface, a remainder of the first temporary set of pavilion facets forming a fifth temporary set of pavilion facets; a remainder of the second temporary set of pavilion facets forming a sixth temporary set of pavilion facets; forming a seventh temporary set of pavilion facets on the lower portion of the gemstone from portions of third temporary set of pavilion facets, the fourth temporary set of pavilion facets, the fifth temporary set of pavilion facets, and the sixth temporary set of pavilion facets, the seventh set of temporary pavilion facets being formed at an angle of between about 40° and about 42° relative to the horizontal upper surface, a remainder of the third temporary set of pavilion facets forming a first final set of pavilion facets, a remainder of the fourth temporary set of pavilion facets forming an second final set of pavilion facets, a remainder of the fifth temporary set of pavilion facets forming an eighth temporary set of pavilion facets, a remainder of the sixth temporary set of pavilion facets forming a ninth temporary set of pavilion facets; and forming a third final set of pavilion facets on the lower portion of the gemstone from the seventh temporary set of pavilion facets, the eighth temporary set of pavilion facets, and the ninth temporary set of pavilion facets, the third final set of pavilion facets being formed at an angle of between about 43° and about 57° relative to the horizontal upper surface, a remainder of the seventh temporary set of pavilion facets forming a fourth final set of pavilion facets, a remainder of the eighth temporary set of pavilion facets forming a fifth final set of pavilion facets, a remainder of the ninth temporary set of pavilion facets forming a sixth final set of pavilion facets, such that the lower portion of the gemstone is formed from the first, second, third, fourth, fifth, and sixth final sets of pavilion facets.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1A:
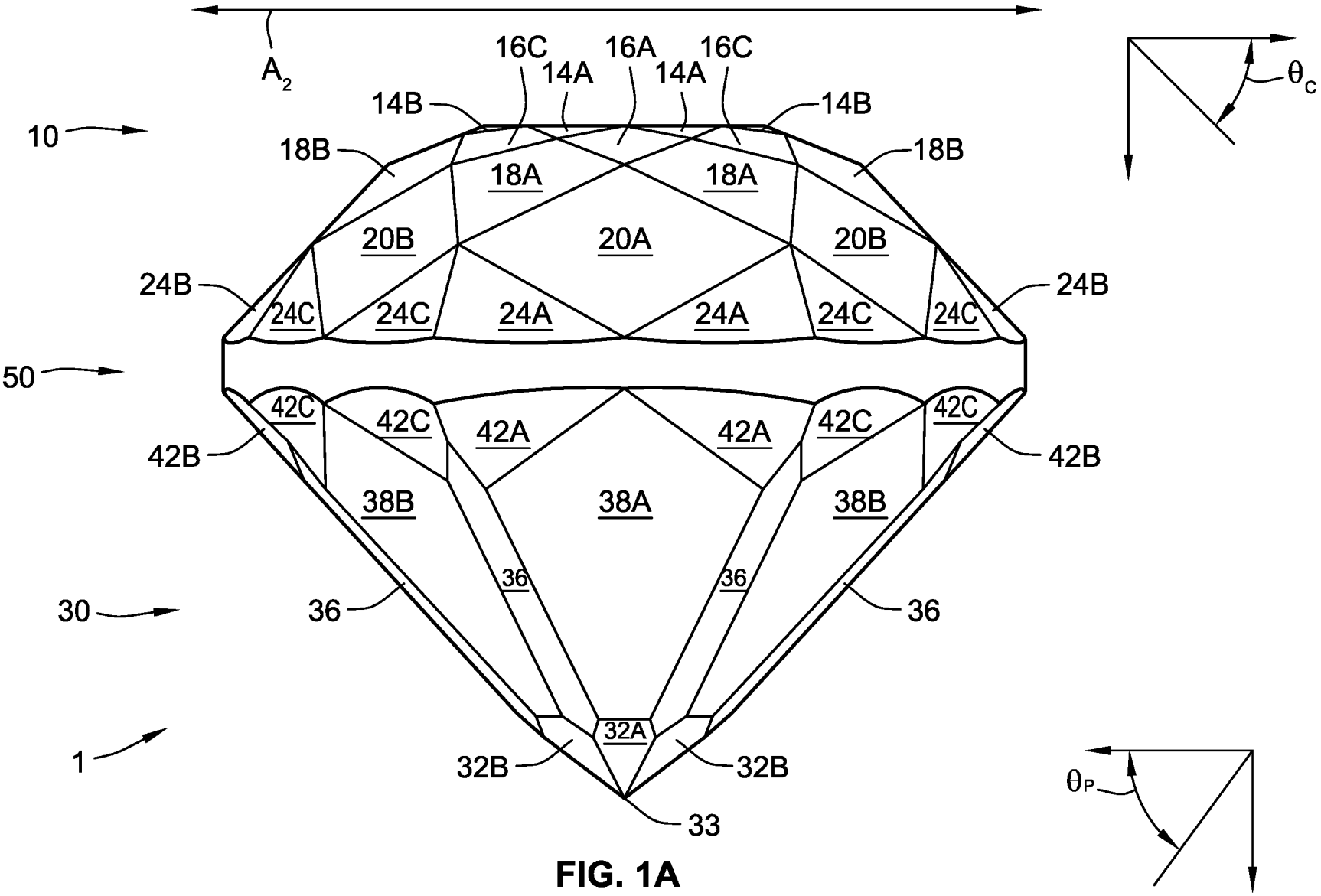
FIG. 1A is a first elevation view of a gemstone along a minor axis, according to some implementations of the present disclosure.

While the present disclosure is susceptible to various modifications and alternative forms, specific implementations and embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Figure 1B:
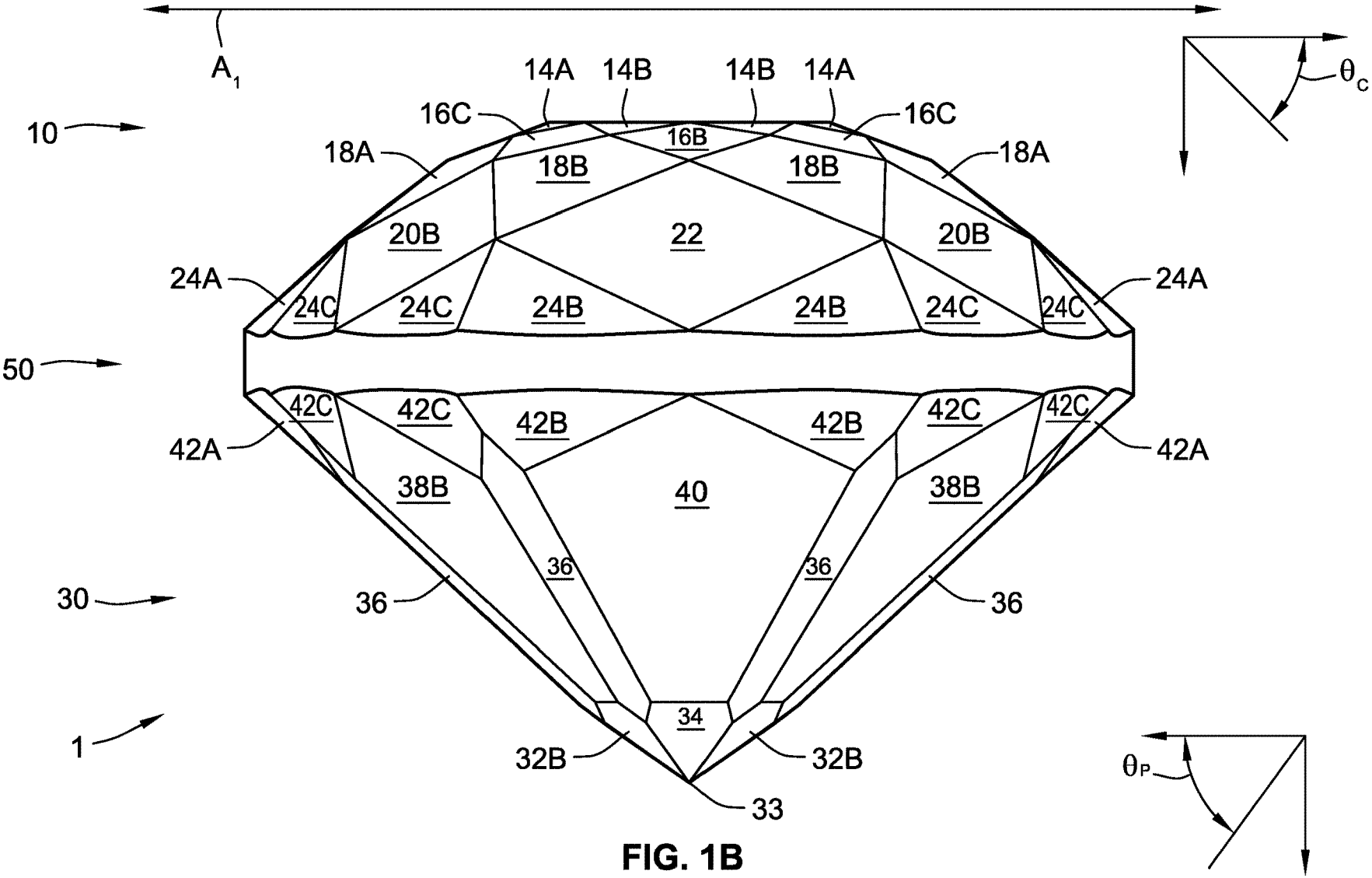
FIG. 1B is a second elevation view of the gemstone of FIG. 1A along a major axis, according to some implementation of the present disclosure.
Figure 2:
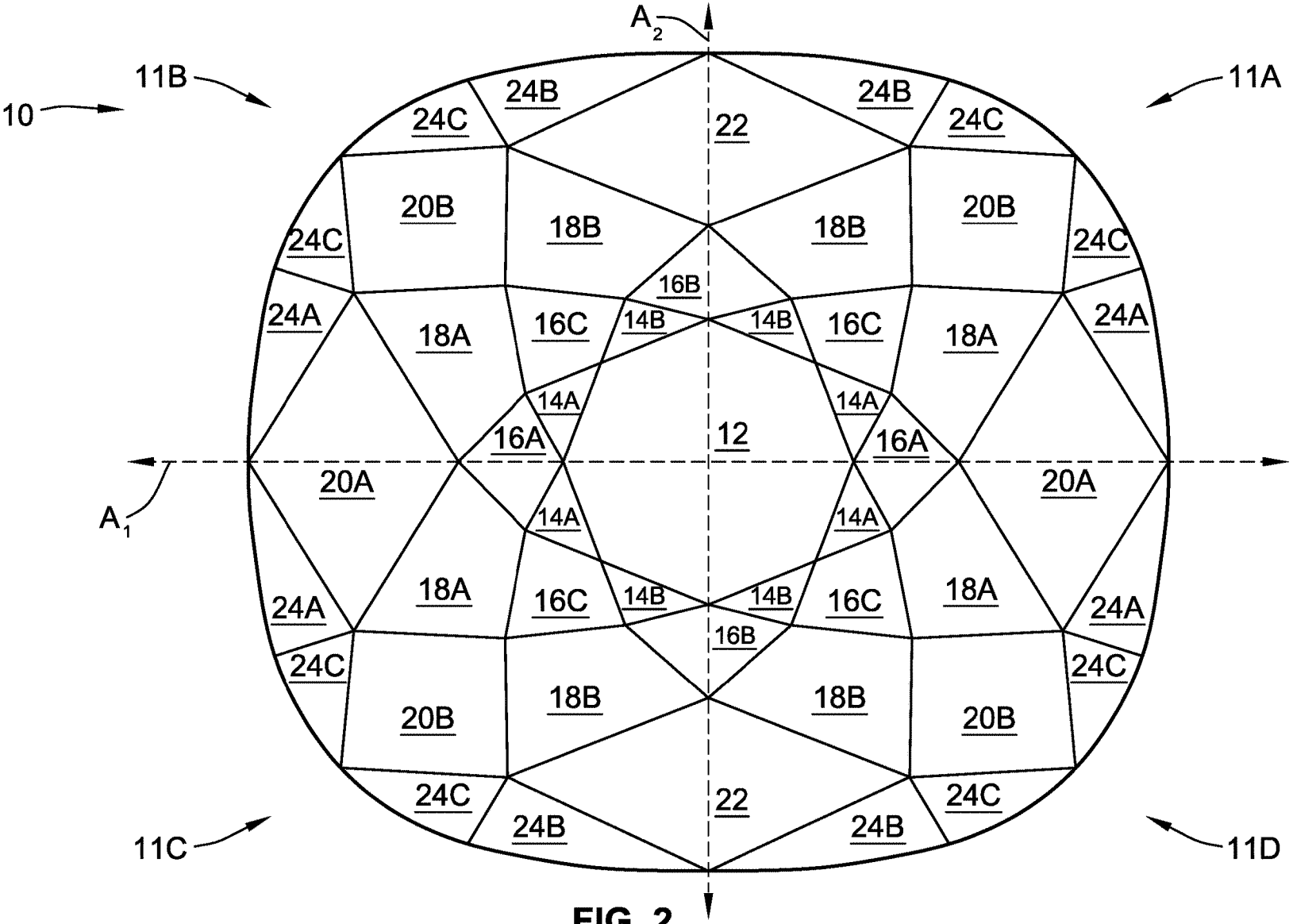
FIG. 2 is a top plan view of the gemstone of FIGS. 1A and 1B, according to some implementations of the present disclosure.

FIGS. 1A and 1B illustrate elevation views of an implementation of the gemstone 1. The gemstone 1 is generally divided into a crown 10 formed as the upper portion of the gemstone 1, a pavilion 30 formed as the lower portion of the gemstone 1, and a girdle 50, which is generally disposed between the crown 10 and the pavilion 30. The girdle 50 generally encircles the entire circumference of the gemstone 1. The crown 10 generally has a flat top surface (as seen in FIG. 2), referred to as a table 12. The lower portion of the gemstone 1 at the pavilion 30 can terminate in a lower point 33 as shown in FIGS. 1A and 1B, or can terminate in a flat facet called a culet. The gemstone 1 is generally a precious stone, such as but not limited to a diamond, ruby, emerald, sapphire, or pearl. The gemstone 1 can also be a synthetic material, such as cubic zirconium. More broadly, the gemstone 1 can include any material capable of being cut, such as, for example, precious or non-precious stones, cubic zirconia, ceramic, metal, plastic, wood, etc.

The girdle 50 is generally the widest portion of the gemstone 1. When the gemstone 1 is viewed from above or below (e.g., the view in FIGS. 2 and 3, respectively), the girdle 50 defines the outer perimeter of the gemstone 1. The gemstone 1 has a cushion shape, which is generally a rectangle, but with rounded corners instead of right-angled corners. Thus, the girdle 50 and the perimeter of the gemstone 1 have a cushion-shaped a cross-section, which is generally rectangular with rounded corners. The cross section of the girdle 50 and the gemstone 1 has a major axis $A_1$ and a minor axis $A_2$ that are generally perpendicular to each other. The dimension of the gemstone 1 along the major axis $A_1$ is larger than the dimension of the gemstone 1 along the minor axis Az. Viewing FIG. 1A, the minor axis $A_2$ extends horizontally relative to the plane of FIG. 1A, while the major axis $A_1$ (not shown) extends into and out of the plane of FIG. 1A. Viewing FIG. 1B, the major axis $A_1$ extends horizontally relative to the plane of FIG. 1B, while the minor axis $A_2$ (not shown) extends into and out of the plane of FIG. 1B. In some implementations however, the girdle 50 and the perimeter of the gemstone 1 have a generally square cross-section with rounded corners, such that the dimensions of the gemstone 1 along the axes are generally equal. It is understood that as used herein, the term cushion-shaped generally refers to either a rectangular or square shape with rounded corners.

The dimensional characteristics of the gemstone 1 are based off of the width of the gemstone 1. The width of the gemstone 1 can also be expressed as the diameter of the girdle 50. The gemstone 1 has a table percentage that is a measure of a width or diameter of the table of the gemstone 1. The table can be formed in a variety of shapes, as thus the measure of the width of the table can vary. In an implementation, the table is a circle, and thus the diameter of the circle is used to express the table percentage of the gemstone 1. In another implementation, the table is an octagon, and either the distance between opposing edges of the octagon or between opposing vertices of the octagon is used to express the table percentage. The table percentage is generally expressed as the width of the table 12 divided by the width of the gemstone 1. In an implementation, the table percentage is between about 31.5% and about 35.5%. In a further implementation, the table percentage is between about 30% and about 40%. In an additional implementation, the table percentage is between about 25% and about 45%. In yet a further implementation the table percentage is about 33.5%.

The gemstone 1 has a top depth percentage that is a measure of the height of the crown 10 of the gemstone 1. The top depth percentage is generally expressed as the height of the crown 10 divided by the width of the gemstone 1. In an implementation, the top depth percentage is between about 24.5% and about 28.5%. In another implementation, the top depth percentage is between about 20% and about 30%. In a further implementation, the top depth percentage is between about 15% and about 35%. In yet a further implementation the top depth percentage is about 26.2%.

The gemstone 1 has a bottom depth percentage that is a measure of the total height of the pavilion 30 of the gemstone 1. The bottom depth percentage is generally expressed as the height of the pavilion 30 divided by the width of the gemstone 1. In an implementation, the bottom depth percentage is between about 48.5% and about 52.5%. In another implementation, the bottom depth percentage is between about 45% and about 55%. In a further implementation the bottom depth percentage is between about 40% and about 60%. In still another implementation, the bottom depth percentage is about 47.6%.

The gemstone 1 has a girdle thickness percentage that is a measure of the total height of the girdle 50 of the gemstone 1. The girdle thickness percentage is generally expressed as the height of the girdle 50 divided by the width of the gemstone 1. In an implementation, the girdle thickness percentage is between about 4% and about 10%. In another implementation, the girdle thickness percentage is between about 6% and about 8%. In a further implementation, the girdle thickness percentage is between about 2% and about 12%. In yet a further implementation the girdle thickness percentage is about 7.6%.

The gemstone 1 has a total depth percentage that is a measure of the total height of the gemstone 1. The total depth percentage is generally expressed as the height of the gemstone 1 divided by the width of the gemstone 1. The total depth percentage may also be expressed as the sum of the top depth percentage, the bottom depth percentage, and the girdle thickness percentage. In an implementation, the total depth percentage is between about 82.5% and about 86.5%. In another implementation, the total depth percentage is between about 80% and about 90%. In further implementation, the total depth percentage is between about 75% and about 95%. In yet a further implementation the total depth percentage is about 84.5%.

The surface of the gemstone 1 is generally divided into a number of groups of interlocking facets disposed at a variety of angles. The facets comprising the surface of the crown 10 generally include a table 12, star facets, upper intermediate crown facets, lower intermediate crown facets, main crown facets, and upper girdle facets. The star facets include major star facets 14A and minor star facets 14B. The upper intermediate crown facets include major upper intermediate crown facets 16A, minor upper intermediate crown facets 16B, and median upper intermediate crown facets 16C. The lower intermediate crown facets include major lower intermediate crown facets 18A and minor lower intermediate crown facets 18B. The main crown facets include central major main crown facets 20A, outer major main crown facets 20B, and minor main crown facets 22. The upper girdle facets include major upper girdle facets 24A, minor upper girdle facets 24B, and median upper girdle facets 24C. The major, minor, and median upper girdle facets 24A, 24B, 24C generally abut an upper edge of the girdle 50.

The groups of facets comprising the surface of the pavilion 30 include culet-adjacent facets, candle facets, main pavilion facets, and lower girdle facets. The culet-adjacent facets include central major culet-adjacent facets 32A, outer major culet-adjacent facets 32B, and minor culet-adjacent facets 34. The candle facets include candle facets 36. The main pavilion facets include central major main pavilion facets 38A, outer major main pavilion facets 38B, and minor main pavilion facets 40. The lower girdle facets include major lower girdle facets 42A, minor lower girdle facets 42B, and median lower girdle facets 42C. The major, minor, and median lower girdle facets 42A, 42B, 42C generally abut a lower edge of the girdle 50.

In an implementation, the girdle 50 is a continuous cushion-shaped facet that encircles the entirety of the gemstone 1. In another implementation, the girdle 50 is divided into a plurality of sub-facets. In yet another implementation, each sub-facet of the girdle 50 comprises a plurality of individual facets. The upper edge of the girdle 50 that abuts the crown 10 may be generally straight or may be curved. The lower edge of the girdle 50 that abuts the pavilion 30 may be generally straight or may be curved.

The angles that each of the facets of the crown 10 are disposed at may be measured relative to a horizontal plane defined by the table of the gemstone 1 (e.g. the top surface of the gemstone 1). As shown in the upper set of axes in FIGS. 1A and 1B, each of the facets of the crown 10 is formed at an angle θc relative to the horizontal plane defined by the table of the gemstone 1. As is shown in FIGS. 1A and 1B, the angle θc that each of the facets of the crown 10 are disposed at is formed by rotating in a clockwise direction downward from the horizontal plane defined by the table.

Generally, every facet within a group of facets is disposed at the same angle or at an angle within the same range. For example, all of the major star facets 14A are disposed at the same angle or at an angle within the same range as the minor star facets 14B. Similarly, all of the major, minor, and median upper intermediate crown facets 16A, 16B, 16C are disposed at the same angle or at an angle with the same range, etc. In some implementations, the range of angles for different groups of facets can overlap, such that two facets within two different groups of facets may have identical or substantially identical angles. Generally, each facets within a group of facets (e.g., all of the star facets, all of the main crown facets, etc.) has the same shape. However, as is discussed in more detail below, due to the oval or elliptical shape of the gemstone, some facets within a group of facets have different shapes.

In an implementation, the angle of the major and minor star facets 14A, 14B is between about 10° and about 17°. In another implementation, the angle of the major and minor star facets 14A, 14B is between about 5° and about 20°. In a further implementation, the angle of the major and minor star facets 14A, 14B is about 12.5°.

In an implementation, the angle of the major, minor, and median upper intermediate crown facets 16A, 16B, 16C is between about 15° and about 24°. In another implementation, the angle of the major, minor, and median upper intermediate crown facets 16A, 16B, 16C is between about 10° and about 30°. In a further implementation, the angle of the major, minor, and median upper intermediate crown facets 16A, 16B, 16C is between about 17° and about 21°. In yet another implementation, the angle of the major, minor, and median upper intermediate crown facets 16A, 16B, 16C is about 18.5°.

In an implementation, the angle of the major and minor lower intermediate crown facets 18A, 18B is about between about 25° and about 35°. In another implementation, the angle of the major and minor lower intermediate crown facets 18A, 18B is between about 25° and about 35°. In still another implementation, the angle of the major and minor lower intermediate crown facets 18A, 18B is between about 20° and about 40°. In a further implementation, the angle of the major and minor lower intermediate crown facets 18A, 18B is between about 29° and about 32°. In yet another further implementation, the angle of the major and minor lower intermediate crown facets 18A, 18B is about 30.5°.

In an implementation, the angle of the central and outer major main crown facets 20A, 20B is between about 37° and about 45°. In another implementation, the angle of the central and outer major main crown facets 20A, 20B is between about 35° and about 50°. In still another implementation, the angle of the central and outer major main crown facets 20A, 20B is between about 30° and about 55°. In a further implementation, the angle of the central and outer major main crown facets 20A, 20B is between about 39° and about 40°. In yet another implementation, the angle of the central and outer major main crown facets 20A, 20B is about 39.5°.

In an implementation, the angle of the minor main crown facets 22 is between about 42° and about 49°. In another implementation, the angle of the minor main crown facets 22 is between about 40° and about 50°. In yet another implementation, the angle of the minor main crown facets 22 is between about 35° and about 55°. In still another implementation, the angle of the minor main crown facets 22 is between about 44° and about 51°. In a further implementation, the angle of the minor main crown facets 22 is between about 45° and about 46°. In yet another implementation, the angle of the minor main crown facets 22 is about 45.5°.

In an implementation, the angle of the major, minor, and median upper girdle facets 24A, 24B, 24C is between about 42.5° and about 57°. In a further implementation, the angle of the major, minor, and median upper girdle facets 24A, 24B, 24C is between about 40° and about 60°. In a further implementation, the angle of the major, minor, and median upper girdle facets 24A, 24B, 24C is between about 44° and about 51°. In a further implementation, the angle of the major, minor, and median upper girdle facets 24A, 24B, 24C is about 47.5°.

The angles that each of the facets of the pavilion 30 are disposed at may also be measured relative to the horizontal plane defined by the table of the gemstone 1 (e.g. the top surface of the gemstone 1). As shown in the lower set of axes in FIGS. 1A and 1B, each of the facets of the pavilion 30 is formed at an angle $\theta_P$ relative to this horizontal plane defined by the table of the gemstone 1. As is shown in FIGS. 1A and 1B, the angle $\theta_P$ that each of the facets of the pavilion 30 are disposed at is formed by rotating in a counterclockwise direction upward from the horizontal plane defined by the table.

In an implementation, the angle of the major culet-adjacent facets 32 is between about 32° and about 38°. In another implementation, the angle of the major culet-adjacent facets 32 is between about 30° and about 40°. In still another implementation, the angle of the major culet-adjacent facets 32 is between about 25° and about 45°. In a further implementation, the angle of the major culet-adjacent facets 32 is between about 34° and about 35°. In yet another implementation, the angle of the major culet-adjacent facets 32 is about 35°.

In an implementation, the angle of the minor culet-adjacent facets 34 is between about 36° and about 42°. In another implementation, the angle of the minor culet-adjacent facets 34 is between about 35° and about 45°. In still another implementation, the angle of the minor culet-adjacent facets 34 is between about 30° and about 50°. In a further implementation, the angle of the minor culet-adjacent facets 34 is between about 38° and about 39°. In yet another implementation, the angle of the minor culet-adjacent facets 34 is about 38.5°.

In an implementation, the angle of the candle facets 36 is between about 40° and about 42°. In another implementation, the angle of the candle facets 36 is between about 35° and about 45°. In another implementation, the angle of the candle facets 36 is between about 30° and about 50°. In a further implementation, the angle of the candle facets 36 is between about 41° and about 44°. In yet another implementation, the angle of the candle facets 36 is about 42°.

In an implementation, the angle of the central and outer major main pavilion facets 38A, 38B is between about 41° and about 45°. In another implementation, the angle of the central and outer major main pavilion facets 38A, 38B is between about 40° and about 50°. In still another implementation, the angle of the central and outer major main pavilion facets 38A, 38B is between about 35° and about 55°. In a further implementation, the angle of the central and outer major main pavilion facets 38A, 38B is between about 43° and about 44°. In yet another implementation, the angle of the central and outer major main pavilion facets 38A, 38B is about 43.5°.

In an implementation, the angle of the minor main pavilion facets 40 is between about 45° and about 49°. In another implementation, the angle of the minor main pavilion facets 40 is between about 40° and about 50°. In a further implementation, the angle of the minor main pavilion facets 40 is between about 35° and about 55°. In yet another implementation, the angle of the minor main pavilion facets 40 is between about 47° and about 48°. In yet a further implementation, the angle of the minor main pavilion facets 40 is about 47.5°.

In an implementation, the angle of the major, minor, and median lower girdle facets 42A, 42B, 42C is between about 43° and about 57°. In another implementation, the angle of the major, minor, and median lower girdle facets 42A, 42B, 42C is between about 40° and about 60°. In yet another implementation, the angle of the major, minor, and median lower girdle facets 42A, 42B, 42C is between about 45° and about 52°. In yet a further implementation, the angle of the major, minor, and median lower girdle facets 42A, 42B, 42C is about 48°.

Referring now to FIG. 2, a top plan view of the gemstone 1 showing the crown 10 is illustrated. The major axis $A_1$ of the perimeter of the gemstone (which is formed by the girdle 50) extends horizontally relative to the plane of FIG. 2, while the minor axis $A_2$ extends vertically relative to the plane of FIG. 2. The major and minor axes $A_1$ and $A_2$ generally divide the facets of the crown 10 into a first quadrant 11A, a second quadrant 11B, a third quadrant 11C, and fourth quadrant 11D. The first quadrant 11A generally corresponds to the top-right corner region of the crown 10 relative to the plane of FIG. 2. The second quadrant 11B generally corresponds to the top-left corner region of the crown 10 relative to the plane of FIG. 2. The third quadrant 11C generally corresponds to the bottom-left corner region of the crown 10 relative to the plane of FIG. 2. The fourth quadrant 11D generally corresponds to the bottom-right corner region of the crown 10 relative to the plane of FIG. 2.

The terms "top," "bottom," "left," "right," "above," below," etc. are used herein to refer to the locations of the various facets on the crown 10. However, those of skill in the art will understand that these are relative terms that are generally used in reference to the plane of FIG. 2. Thus, any of these terms used to describe an individual facet may not apply when viewing the crown 10 from a different perspective. The facets on the surface of the crown 10 share edges and vertices where the facets meet. When describing the facets on the surface of the crown 10, the term "upper" is used to refer to edges or vertices nearer to the table 12, while the term "lower" is used to refer to edges or vertices nearer to the girdle 50.

The crown 10 includes a number of main crown facets, which include six major main crown facets 20A, 20B, and two minor main crown facets 22. Relative to the plane of FIG. 2, the six major main crown facets 20A, 20B are generally disposed either to the left or to the right along the major axis $A_1$. The major main crown facets 20A, 20B are divided into two groups of three major main crown facets 20A, 20B. A left group of three major main crown facets 20A, 20B is generally disposed along the left side of the major axis $A_1$, which is to the left of the minor axis $A_2$. A right group of three major main crown facets 20A, 20B is generally disposed along the right side of the major axis $A_1$, which is to the right of the minor axis $A_2$.

The major main crown facets 20A, 20B within the left group of major main crown facets 20A, 20B extend generally vertically relative to the plane of FIG. 2. In this manner, the three major main crown facets 20A, 20B within the left group of major main crown facets 20A, 20B are aligned along an axis that is parallel to and to the left of the minor axis $A_2$. Similarly, the major main crown facets 20A, 20B within the right group of major main crown facets 20A, 20B also extend generally vertically relative to the plane of FIG. 2. In this manner, the three major main crown facets 20A, 20B within the right group of major main crown facets 20A, 20B are aligned along an axis that is parallel to and to the right of the minor axis Az.

Each group of three major main crown facets includes a central major main crown facet 20A surrounded by two outer major main crown facets 20B. The two central major main crown facets 20A (e.g. the left and right central major main crown facets 20A relative to the plane of FIG. 2) are generally aligned along the major axis $A_1$. The left central major main crown facet 20A extends into both the second quadrant 11B and the third quadrant 11C. The right central major main crown facet 20A extends into both the first quadrant 11A and the fourth quadrant 11D.

Relative to the plane of FIG. 2, the two outer major main crown facets 20B above the central major main crown facets 20A (e.g., the top-right and top-left major main crown facets 20B) are aligned along a line parallel to and above the major axis $A_1$. Similarly, relative to the plane of FIG. 2, the two outer major main crown facets 20B below the central major main crown facets 20A (e.g., the bottom-left and bottom-right major main crown facets 20B) are aligned along a line parallel to and below the major axis $A_1$. The top-right major main crown facet 20B is disposed in the first quadrant 11A. The top-left major main crown facet 20B is disposed in the second quadrant 11B. The bottom-left major main crown facet 20B is disposed in the third quadrant 11C. The bottom-right major main crown facet 20B is disposed in the fourth quadrant 11D. Generally, at least a portion of each of the major main crown facets 20A, 20B is disposed between two of the lower intermediate crown facets 18A, 18B.

The two minor main crown facets 22 are generally aligned along the minor axis $A_2$. Relative to the plane of FIG. 2, one of the minor main crown facets 22 (e.g., the top minor main crown facet 22) is generally disposed along the top side of the minor axis $A_2$, which is above the major axis $A_1$. The other minor main crown facet 22 (e.g., the bottom minor main crown facet 22) is disposed along the bottom side of the minor axis $A_2$, which is below the major axis $A_1$. The top minor main crown facet 22 generally extends into both the first quadrant 11A and the second quadrant 11B. The bottom minor main crown facet 22 generally extends into both the third quadrant 11C and the fourth quadrant 11D. Generally, at least a portion of each of the minor main crown facets 22 is disposed between two of the lower intermediate crown facets 18A, 18B.

Each major main crown facet 20A, 20B is generally diamond or kite-shaped (e.g., four sides) with an upper vertex, a lower vertex, and two lateral vertices. The lower vertex of each major main crown facet 20A, 20B abuts the upper edge of the girdle. Similarly, each minor main crown facet 22 is generally diamond or kite-shaped (e.g., four sides) with an upper vertex, a lower vertex, and two lateral vertices. The lower vertex of each minor main crown facet 22 abuts the upper edge of the girdle. Each central major main crown facet 20A shares first and second edges with two adjacent major upper girdle facets 24A, and third and fourth edges with two adjacent major lower intermediate crown facets 18A. Each outer major main crown facet 20B shares first and second edges with two adjacent median upper girdle facets 24C, a third edge with an adjacent major lower intermediate crown facet 18A, and a fourth edge with an adjacent minor lower intermediate crown facet 18B. Each minor main crown facet 22 shares first and second edges with two adjacent minor upper girdle facets 24B, and third and fourth edges with two adjacent minor lower intermediate crown faces 18B.

The two lateral vertices of each minor main crown facet 22 abut the lateral vertex of one of the outer major main crown facets 20B. The two lateral vertices of the central major main crown facet 20A abut the lateral vertex of one of the outer major main crown facets 20B, opposite the lateral vertex of that same outer major main crown facet 20B that abuts the lateral vertex of one of the central major main crown facets 20A. The lateral vertices of the outer major main crown facets 20B of each group of three major main crown facets 20A, 20B abut one lateral vertex of one of the central major main crown facets 20A and one lateral vertex of one of the minor main crown facets 22.

The upper vertex of the central major main crown facets 20A abuts a lower vertex of an adjacent major upper intermediate crown facet 16A, and a lateral vertex of each of two adjacent major lower intermediate crown facets 18A. The upper vertex of each outer major main crown facet 20B abuts a lower vertex of an adjacent median upper intermediate crown facet 16C, a lateral vertex of an adjacent major lower intermediate crown facet 18A, and a lateral vertex of an adjacent minor lower intermediate crown facet 18B. The upper vertex of the minor main crown facets 22 abuts a lower vertex of an adjacent minor upper intermediate crown facet 16B, and a lateral vertex of each of two adjacent minor lower intermediate crown facets 18B.

The upper vertex of each of the outer major main crown facets 20B is generally shifted away from the nearest central major main crown facet 20A, and toward the nearest minor main crown facet 22. In this manner, the angle bisector of the upper vertex of the outer major main crown facets 20B does not also bisect the angle formed at the lower vertex of the outer major main crown facets 20B. In contrast, the angle bisectors of upper and lower vertices of the central major main crown facets 20A are generally parallel. In addition, the distance between the lateral vertices of the central major main crown facets 20A and the minor main crown facets 22 is generally greater than the distance between the lateral vertices of the outer major main crown facets 20B. Thus, the central major main crown facets 20A and the minor main crown facets 20B are generally wider than the outer major main crown facets 20B.

Thus, while all of the central and outer major main crown facets 20A, 20B generally have the same angle or an angle within the same range, the central and outer major main crown facets 20A, 20B can have slightly differ different shapes depending on their location along the crown 10 of the gemstone 1. However, in some implementations, any one of the groups of main crown facets 20A, 20B, 22 can have the same size and shape as any of the other groups of main crown facets 20A, 20B, 22.

The crown 10 includes four major upper girdle facets 24A, four minor upper girdle facets 24B, and eight median upper girdle facets 24C. Relative to the plane of FIG. 2, the four major upper girdle facets 24A are disposed either to the left or to the right on the crown 10 along the major axis $A_1$. The major upper girdle facets 24A are divided into two groups of two major upper girdle facets 24A. A left group of two major upper girdle facets 24A is generally disposed along the left side of the major axis $A_1$, which is to the left of the minor axis $A_2$. A right group of two major upper girdle facets 24A is generally disposed along the right side of the major axis $A_1$, which is to the right of the minor axis $A_2$. The major upper girdle facets 24A within the left group of major upper girdle facets 24A extend generally vertically relative to the plane of FIG. 2. In this manner, the two major upper girdle facets 24A within the left group of major upper girdle facets 24A are aligned along an axis that is parallel to and to the left of the minor axis $A_2$. Similarly, the major upper girdle facets 24A within the right group of major upper girdle facets 24A also extend generally vertically relative to the plane of FIG. 2. In this manner, the two major upper girdle facets 24A within the right group of major upper girdle facets 24A are aligned along an axis that is parallel to and to the right of the minor axis $A_2$.

One major upper girdle facet 24A of the right group of major upper girdle facets 24A is disposed generally in the first quadrant 11A of the crown 10. The other major upper girdle facet 24A of the right group of major upper girdle facets 24A is disposed generally in the fourth quadrant 11D of the crown 10. One major upper girdle facet 24A of the left group of major upper girdle facets 24A is disposed generally in the second quadrant 11B of the crown 10. The other major upper girdle facet 24A of the left group of major upper girdle facets 24A is disposed generally in the third quadrant 11C of the crown 10.

Relative to the plane of FIG. 2, the four minor upper girdle facets 24B are disposed either toward the top of the crown 10, or toward the bottom of the crown 10, along the minor axis $A_2$. The minor upper girdle facets 24B are divided into two groups of two minor upper girdle facets 24B. A top group of two minor upper girdle facets 24B is generally disposed along the top side of the minor axis $A_2$, which is above the major axis $A_1$. A bottom group of two minor upper girdle facets 24B is generally disposed along the bottom side of the minor axis $A_2$, which is below the major axis $A_1$. The minor upper girdle facets 24B within the top group of minor upper girdle facets 24B extend generally horizontally relative to the plane of FIG. 2. In this manner, the two minor upper girdle facets 24B within the top group of minor upper girdle facets 24B are aligned along an axis that is parallel to and above the major axis $A_1$. Similarly, the minor upper girdle facets 24B within the bottom group of minor upper girdle facets 24B also extend generally horizontally relative to the plane of FIG. 2. In this manner, the two minor upper girdle facets 24B within the bottom group of minor upper girdle facets 24B are aligned along an axis that is parallel to and below the major axis $A_1$.

One minor upper girdle facet 24B of the top group of minor upper girdle facets 24B is disposed generally in the first quadrant 11A of the crown 10. The other minor upper girdle facet 24B of the top group of minor upper girdle facets 24B is disposed generally in the second quadrant 11B of the crown 10. One minor upper girdle facet 24B of the bottom group of minor upper girdle facets 24B is disposed generally in the third quadrant 11C of the crown 10. The other minor upper girdle facet 24B of the bottom group of minor upper girdle facets 24B is disposed generally in the fourth quadrant 11D of the crown 10.

Relative to the plane of FIG. 2, the eight median upper girdle facets 24C are generally positioned diagonally relative to the major axis $A_1$ and the minor axis $A_2$. The median upper girdle facets 24C are divided into four groups of two median upper girdle facets 24C. A top-right group of median upper girdle facets 24C is positioned in the first quadrant 11A, above the major axis $A_1$ and to the right of the minor axis $A_2$. A top-left group of median upper girdle facets 24C is positioned in the second quadrant 11B, above the major axis $A_1$ and to the left of the minor axis $A_2$. A bottom-left group of median upper girdle facets 24C is positioned in the third quadrant 11C, below the major axis $A_1$ and to the left of the minor axis $A_2$. A bottom-right group of median upper girdle facets 24C is positioned in the fourth quadrant 11D, below the major axis $A_1$ and to the right of the minor axis $A_2$.

Each of the major upper girdle facets 24A is disposed between one of the central major main crown facets 20A, an adjacent one of the outer main crown facets 20B, and the upper edge of the girdle 50. Each of the major upper girdle facets 24A has a generally triangular shape. A first edge of each of the major upper girdle facets 24A is shared with the girdle 50, and can be flat or curved depending on the shape of the girdle 50. A second edge of each of the major upper girdle facets 24A is shared with one of the central major main crown facets 20A.

As shown, each of the major upper girdle facets 24A shares a third edge with an adjacent one of the median upper girdle facets 24C. One of the left group of major upper girdle facets 24A shares its third edge with one of the top-left median upper girdle facets 24C. The other of the left group of major upper girdle facets 24A shares its third edge with one of the bottom-left median upper girdle facets 24C. One of the right group of major upper girdle facets 24A shares its third edge with one of the top-right median upper girdle facets 24C. The other of the right group of major upper girdle facets 24A shares its third edge with one of the bottom-right median upper girdle facets 24C. Thus, each major girdle facet 24A is part of a pair of upper girdle facets along with its corresponding median upper girdle facet 24C.

The minor upper girdle facets 24B are disposed in a similar fashion as the major upper girdle facets 24A. Each of the minor upper girdle facets 24B is disposed between one of the outer major main crown facets 20B, an adjacent one of the minor main crown facets 22, and the upper edge of the girdle 50. Each of the minor upper girdle facets 24B has a generally triangular shape. A first edge of each of the minor upper girdle facets 24B is shared with the girdle 50, and can be flat or curved depending on the shape of the girdle 50. A second edge of each of the minor upper girdle facets 24B is shared with one of the minor main crown facets 22.

As shown, each of the minor upper girdle facets 24B shares a third edge with an adjacent one of the median upper girdle facets 24C. One of the top group of minor upper girdle facets 24B shares its third edge with one of the top-left median upper girdle facets 24C. The other of the top group of minor upper girdle facets 24B shares its third edge with one of the top-right median upper girdle facets 24C. One of the bottom group of minor upper girdle facets 24B shares its third edge with one of the bottom-left median upper girdle facets 24C. The other of the bottom group of minor upper girdle facets 24B shares its third edge with one of the bottom-right median upper girdle facets 24C. Thus, each minor girdle facet 24B is part of a pair of upper girdle facets along with its corresponding median upper girdle facet 24C.

Each of the median crown facets 16C is disposed between the upper edge of the girdle, one of the outer major main crown facets 20B, and either (i) an adjacent one of the central major main crown facets 20A, or (ii) an adjacent one of the minor main crown facets 22. Each of the median upper girdle facets 24C has a generally triangular shape. A first edge of each of the median upper girdle facets 24C is shared with the girdle 50, and can be flat or curved depending on the shape of the girdle 50. A second edge of each of the median upper girdle facets 24C is shared with one of the outer major main crown facets 20B.

As shown, each of the minor upper girdle facets 24B shares a third edge with either (i) an adjacent one of the major upper girdle facets 24A, or (ii) an adjacent one of the minor upper girdle facets 24B. One of the top-right group of median upper girdle facets 24C shares its third edge with one of the right group of major upper girdle facets 24A. The other of the top-right group of median upper girdle facets 24C shares its third edge with one of the top group of minor upper girdle facets 24B. One of the top-left group of median upper girdle facets 24C shares its third edge with one of the top group of minor upper girdle facets 24B. The other of the top-left group of median upper girdle facets 24C shares its third edge with one of the left group of major upper girdle facets 24A. One of the bottom-left group of median upper girdle facets 24C shares its third edge with one of the left group of major upper girdle facets 24A. The other of the bottom-left group of median upper girdle facets 24C shares its third edge with one of the bottom group of minor upper girdle facets 24B. One of the bottom-right group of median upper girdle facets 24C shares its third edge with one of the bottom group of minor upper girdle facets 24B. The other of the bottom-right group of median upper girdle facets 24C shares its third edge with one of the right group of major upper girdle facets 24A. Thus, each median upper girdle facet 24C is part of a pair of upper girdle facets along with either its corresponding major upper girdle facet 24A or its corresponding minor upper girdle facet 24B.

Each of the major, minor, and median upper girdle facets 24A, 24B, 24C has two lower vertices and an upper vertex. Each of the two lower vertices of each respective upper girdle facet abuts both (i) the upper edge of the girdle and (ii) a lower vertex of an adjacent one of the upper girdle facets 24A, 24B, 24C. For the major upper girdle facets 24A, one of the lower vertices abuts a lower vertex of the other major upper girdle facet 24A in the same group (e.g., left or right). The other lower vertex abuts a lower vertex of an adjacent one of the median upper girdle facets 24C. For the minor upper girdle facets 24B, one of the lower vertices abuts a lower vertex of the other minor upper girdle facet 24B in the same group (e.g. top or bottom). The other lower vertex abuts a lower vertex of an adjacent one of the median upper girdle facets 24C. For the median upper girdle facets 24C, one of the lower vertices abuts a lower vertex of the other minor upper girdle facet 24B in the same group (e.g., top-right, top-left, bottom-left, or bottom-right). The other lower vertex abuts a lower vertex of either (i) one of the major upper girdle facets 24A or (ii) one of the minor upper girdle facets 24B.

The upper vertex of each major upper girdle facet 24A abuts a vertex of (i) an adjacent one of the median upper girdle facets 24C, (ii) one of the central major main crown facets 20A, (iii) one of the outer major main crown facets 20B, and (iv) one of the major lower intermediate crown facets 18A. The upper vertex of each minor upper girdle facet 24B abuts a vertex of (i), an adjacent one of the median upper girdle facets 24C (ii) one of the outer major main crown facets 20B, (iii) one of the minor main crown facets 22, and (iv) one of the minor lower intermediate crown facets 18B. The upper vertex of each median upper girdle facet 24C abuts a vertex of (i), either an adjacent one of the major upper girdle facets 24A or an adjacent one of the minor upper girdle facets 24B, (ii) one of the outer major main crown facets 20B, (iii) either one of the central major main crown facets 20A or one of the minor main crown facets 22, and (iv) either one of the major lower intermediate crown facets 18A or one of the minor lower intermediate crown facets 18B.

In the illustrated implementation, the lower edge of each major and minor upper girdle facet 24A, 24B that abuts the upper edge of the girdle is larger than the lower edge of each median upper girdle facet 24C that abuts the upper edge of the girdle. Thus, the major and minor upper girdle facets 24A, 24B are generally larger than the median upper girdle facets 24C. However, in other implementations, the lower edge of each major and minor upper girdle facet 24A, 24B is generally the same length as the lower edge of each median upper girdle facet 24C, such that all of the major, minor, and median upper girdle facets 24A, 24B, 24C are the same size.

The crown 10 includes sixteen lower intermediate crown facets. Major lower intermediate crown facets 18A are disposed between the major main crown facets 20A, 20B, and the table 12. Minor lower intermediate crown facets 18B are disposed between major crown facets 20B and minor crown facets 22, and the table 12.

Relative to the plane of FIG. 2, the major lower intermediate crown facets 18A are disposed either to the left or to the right on the crown 10 along the major axis $A_1$. The major lower intermediate crown facets 18A are divided into two groups of two major lower intermediate crown facets 18A. A left group of two major lower intermediate crown facets 18A is generally disposed along the left side of the major axis $A_1$, which is to the left of the minor axis $A_2$. A right group of two major lower intermediate crown facets 18A is generally disposed along the right side of the major axis $A_1$, which is to the right of the minor axis $A_2$.

The major lower intermediate crown facets 18A within the left group of major lower intermediate crown facets 18A extend generally vertically relative to the plane of FIG. 2. In this manner, the two major lower intermediate crown facets 18A within the left group of major lower intermediate crown facets 18A are aligned along an axis that is parallel to and to the left of the minor axis $A_2$. Similarly, the major lower intermediate crown facets 18A within the right group of major lower intermediate crown facets 18A also extend generally vertically relative to the plane of FIG. 2. In this manner, the two major lower intermediate crown facets 18A within the right group of major lower intermediate crown facets 18A are aligned along an axis that is parallel to and to the right of the minor axis $A_2$. The left group of two major lower intermediate crown facets 18A thus includes a top-left major lower intermediate crown facet 18A and a bottom-left major lower intermediate crown facet 18A. The right group of two major lower intermediate crown facets 18A thus includes a top-right major lower intermediate crown facet 18A and a bottom-right major lower intermediate crown facet 18A.

Relative to the plane of FIG. 2, the minor lower intermediate crown facets 18B are disposed either toward the top of the crown 10 or toward the bottom of the crown 10, along the minor axis $A_2$. The minor lower intermediate crown facets 18B are divided into two groups of two minor lower intermediate crown facets 18B. A top group of two minor lower intermediate crown facets 18B is generally disposed along the top side of the minor axis $A_2$, which is above the major axis $A_1$. A bottom group of two minor lower intermediate crown facets 18B is generally disposed along the bottom side of the minor axis $A_2$, which is below the major axis $A_1$.

The minor lower intermediate crown facets 18B within the top group of minor lower intermediate crown facets 18B extend generally horizontally relative to the plane of FIG. 2. In this manner, the two minor lower intermediate crown facets 18B within the top group of minor lower intermediate crown facets 18B are aligned along an axis that is parallel to and above the major axis $A_1$. Similarly, the minor lower intermediate crown facets 18B within the bottom group of minor lower intermediate crown facets 18B also extend generally horizontally relative to the plane of FIG. 2. In this manner, the two minor lower intermediate crown facets 18B within the bottom group of minor lower intermediate crown facets 18B are aligned along an axis that is parallel to and below the major axis $A_1$. The top group of two minor lower intermediate crown facets 18B thus includes a top-left minor lower intermediate crown facet 18B and a top-right minor lower intermediate crown facet 18B. The bottom group of two minor lower intermediate crown facets 18B thus includes a bottom-left minor lower intermediate crown facet 18B and a bottom-right major lower intermediate crown facet 18A.

The top-right major and minor lower intermediate crown facets 18A, 18B are disposed generally in the first quadrant 11A of the crown 10. The top-left major and minor lower intermediate crown facets 18A, 18B are disposed generally in the second quadrant 11B of the crown 10. The bottom-left major and minor lower intermediate crown facets 18A, 18B are disposed generally in the third quadrant 11C of the crown 10. The bottom-right major and minor lower intermediate crown facets 18A, 18B are disposed generally in the fourth quadrant 11D of the crown 10.

Each of the major and minor lower intermediate crown facets 18A, 18B, are generally diamond or kite-shaped (e.g., four sides) with an upper vertex, a lower vertex, and two lateral vertices. Generally, each of the lower intermediate crown facets 18A, 18B is disposed between two of the upper intermediate crown facets 16A, 16B, 16C. An upper portion of each major lower intermediate crown facet 18A is positioned between one of the major upper intermediate crown facets 16A and an adjacent one of the median upper intermediate crown facets 16C. A lower portion of each major lower intermediate crown facet 18A is positioned between one of the center major main crown facets 20A and an adjacent one of the outer major main crown facets 20B.

An upper portion of each minor lower intermediate crown facet 18B is positioned between one of the minor upper intermediate crown facets 16B and an adjacent one of the median upper intermediate crown facets 16C. A lower portion of each minor lower intermediate crown facet 18B is positioned between one of the minor main crown facets 22 and an adjacent one of the outer major main crown facets 20B.

A lower vertex of each major lower intermediate crown facet 18A abuts a lateral vertex of one of the central major main crown facets 20A, a lateral vertex of an adjacent one of the outer major main crown facets 20B, the top vertex of one of the major upper girdle facets 24A, and the top vertex of an adjacent one of the median upper girdle facets 24C. One lateral vertex of each major lower intermediate crown facet 18A abuts the top vertex of one of the central major main crown facets 20A, and the lateral vertex of an adjacent major lower intermediate crown facet 18A. The other lateral vertex of each major lower intermediate crown facet 18A abuts the top vertex of one of the outer major main crown facets 20B, and the lateral vertex of an adjacent minor lower intermediate crown facet 18B. Each major lower intermediate crown facet 18A shares a first edge with one of the central major main crown facets 20A, a second edge with one of the outer major main crown facets 20B, a third edge with a major upper intermediate crown facet 16A, and a fourth edge with an adjacent median upper intermediate crown facet 16C.

A lower vertex of each minor lower intermediate crown facet 18B abuts a lateral vertex of one of the outer major main crown facets 20B, a lateral vertex of an adjacent one of the minor main crown facets 22, the top vertex of one of the minor upper girdle facets 24B, and the top vertex of an adjacent one of the median upper girdle facets 24C. One lateral vertex of each minor lower intermediate crown facet 18B abuts the top vertex of one of the outer major main crown facets 20B, and the lateral vertex of an adjacent major lower intermediate crown facet 18A. The other lateral vertex of each minor lower intermediate crown facet 18B abuts the top vertex of one of the minor main crown facets 22, and the lateral vertex of an adjacent minor lower intermediate crown facet 18B. Each minor lower intermediate crown facet 18B shares a first edge with one of the outer major main crown facets 20B, a second edge with one of the minor main crown facets 22, a third edge with a minor upper intermediate crown facet 16B, and a fourth edge with an adjacent median upper intermediate crown facet 16C.

The upper vertex of each of the major lower intermediate crown facets 18A abuts an upper vertex of a corresponding one of the major star facets 14A. Similarly, the upper vertex of each of the minor lower intermediate crown facets 18B abuts an upper vertex of a corresponding one of the minor star facets 14B. The upper vertex of each of the major lower intermediate crown facets 18A is generally shifted away from the central major main crown facet 20A toward the nearest outer major main crown facet 20B.

The upper vertex of each of the minor lower intermediate crown facets 18B is generally shifted away from the nearest outer major main crown facet 20B toward the nearest minor main crown facet 22. In this manner, the angle bisector of the upper vertex of each major lower intermediate crown facets 18A does not also bisect the angle formed at the lower vertex of each lower intermediate crown facet 18A. Similarly, the angle bisector of the upper vertex of the minor lower intermediate crown facets 18B does not also bisect the angled formed at the lower vertex of each minor lower intermediate crown facet 18B.

Thus, while all of the major and minor lower intermediate crown facets 18A, 18B generally have the same angle or an angle within the same range, the major and minor lower intermediate crown facets 18A, 18B can have different shapes depending on their location along the crown 10 of the gemstone 1. However, in some implementations, the major lower intermediate crown facets 18A can have the same size and shape as the minor lower intermediate crown facets 18B.

The crown 10 includes eight upper intermediate crown facets 16A, 16B, 16C, disposed between the major and minor lower intermediate crown facets 18A, 18B, and the table 12. The upper intermediate crown facets include two major upper intermediate crown facets 16A, two minor upper intermediate crown facets 16B, and two median upper intermediate crown facets 16C.

Relative to the plane of FIG. 2, the major upper intermediate crown facets 16A are disposed either to the left or to the right on the crown 10 along the major axis $A_1$. A left major upper intermediate crown facet 16A is generally disposed along the left side of the major axis $A_1$, which is to the left of the minor axis $A_2$. A right major upper intermediate crown facet 16A is generally disposed along the right side of the major axis $A_1$, which is to the right of the minor axis $A_2$. The left major upper intermediate crown facet 16A generally extends into both the second quadrant 11B and the third quadrant 11C. The right major upper intermediate crown facet 16A generally extends into both the first quadrant 11A and the fourth quadrant 11D.

Relative to the plane of FIG. 2, the minor upper intermediate crown facets 16B are disposed either toward the top of the crown 10 or toward the bottom of the crown 10, along the minor axis $A_2$. A top minor upper intermediate crown facet 16B is generally disposed along the top side of the minor axis $A_2$, which is above the major axis $A_1$. A bottom minor upper intermediate crown facet 16B is generally disposed along the bottom side of the minor axis $A_2$, which is below the major axis $A_1$. The top minor upper intermediate crown facet 16B generally extends into both the first quadrant 11A and the second quadrant 11B. The bottom minor upper intermediate crown facet 16B generally extends into both the third quadrant 11C and the fourth quadrant 11D.

The four median upper intermediate crown facets 16C are generally positioned diagonally relative to the major axis $A_1$ and the minor axis $A_2$. A top-right median upper intermediate crown facet 16C is positioned in the first quadrant 11A, above the major axis $A_1$ and to the right of the minor axis $A_2$. A top-left median upper intermediate crown facet 16C is positioned in the second quadrant 11B, above the major axis $A_1$ and to the left of the minor axis $A_2$. A bottom-left median upper intermediate crown facet 16C is positioned in the third quadrant 11C, below the major axis $A_1$ and to the left of the minor axis $A_2$. A bottom-right median upper intermediate crown facet 16C is positioned in the fourth quadrant 11D, below the major axis $A_1$ and to the right of the minor axis $A_2$.

An upper portion of each major upper intermediate crown facet 16A is positioned between two of the major star facets 14A. A lower portion of each major upper intermediate crown facet 16A is positioned between two of the major lower intermediate crown facets 18A. An upper portion of each minor upper intermediate crown facet 16B is positioned between two of the minor star facets 14A. A lower portion of each minor upper intermediate crown facet 16B is positioned between two of the minor lower intermediate crown facets 18B. An upper portion of each median upper intermediate crown facet 16C is positioned between one of the major star facets 14A and an adjacent one of the minor star facets 14B. A lower portion of each median upper intermediate crown facet 16C is positioned between one of the major lower intermediate crown facets 18A and an adjacent one of the minor lower intermediate crown facets 18B.

All of the upper intermediate crown facets 16A, 16B, 16C, are generally diamond or kite-shaped (e.g., four sides) with an upper vertex, a lower vertex, and two lateral vertices. The lower vertex of each major upper intermediate crown facet 16A abuts the upper vertex of one of the central major main crown facets 20A, as well as lateral vertices of a pair of adjacent major lower intermediate crown facets 18A. The lateral vertices of each major upper intermediate crown facet 16A abut the upper vertex of one of the major lower intermediate crown facets 18A, as well as one of the lateral vertices of an adjacent median upper intermediate crown facet 16C. Each major upper intermediate crown facet 16A shares first and second edges with two adjacent major lower intermediate crown facets 18A, and third and fourth edges with two adjacent major star facets 14A. The upper vertex of each of the upper intermediate crown facets 16A, 16B, 16C abuts a vertex of the table 12.

The lower vertex of each minor upper intermediate crown facet 16B abuts the upper vertex of one of the minor main crown facets 22, as well as lateral vertices of a pair of adjacent minor lower intermediate crown facets 18B. The lateral vertices of each minor upper intermediate crown facet 16B abut the upper vertex of one of the minor lower intermediate crown facets 18B, as well as one of the lateral vertices of an adjacent median upper intermediate crown facet 16C. Each minor upper intermediate crown facet 16B shares first and second edges with two adjacent minor lower intermediate crown facets 18B, and third and fourth edges with two adjacent minor star facets 14B.

The lower vertex of each median upper intermediate crown facet 16C abuts the upper vertex of one of the outer major main crown facets 20B, one of the lateral vertices of one of the major lower intermediate crown facets 18A, and one of the lateral vertices of one of the minor lower intermediate crown facets 18B. One of the lateral vertices of each median upper intermediate crown facet 16C abuts the upper vertex of one of the major lower intermediate crown facets 18A and one of the lateral vertices of an adjacent major upper intermediate crown facet 16A. The other lateral vertex of each median upper intermediate crown facet 16C abuts the upper vertex of one of the minor lower intermediate crown facets 18B and one of the lateral vertices of an adjacent minor upper intermediate crown facet 16B. Each median upper intermediate crown facet 16C shares a first edge with an adjacent major lower intermediate crown facet 18A, a second edge with an adjacent minor lower intermediate crown facet 18B, a third edge with an adjacent major star facet 14A, and a fourth edge with an adjacent minor star facet 14B.

Each of the major, minor, and median upper intermediate crown facets 16A, 16B, 16C are generally shaped differently due to the oval or elliptical shape of the gemstone 1. The distance between the upper and lower vertices of the major upper intermediate crown facets 16A is generally larger than the distance between the upper and lower vertices of the minor and median upper intermediate crown facets 16B, 16C. The major upper intermediate crown facets 16A are thus generally vertically elongated (e.g., between the girdle 50 and the table 12). The distance between the lateral vertices of the minor upper intermediate crown facets 16B is generally larger than the distance between the lateral vertices of the major and median upper intermediate crown facets 16A, 16C. The minor upper intermediate crown facets 16B are thus laterally elongated (e.g., along the circumference of the crown 10).

Both the major upper intermediate crown facets 16A and the minor upper intermediate crown facets 16B are generally symmetrical. However, the median upper intermediate crown facets 16C are generally asymmetrical. The upper vertex of each of the median upper intermediate crown facets 16C is shifted slightly toward the adjacent one of the minor upper intermediate crown facets 16B. In this manner, the angle bisector of the upper vertex of the median upper intermediate crown facets 16C is generally not parallel to the angle bisector of the lower vertex of the median upper intermediate crown facets 16C.

Thus, while all of the major, minor, and median upper intermediate crown facets 16A, 16B, 16C generally have the same angle or an angle within the same range, the major, minor, and median upper intermediate crown facets 16A, 16B, 16C can have different shapes depending on their location along the crown 10 of the gemstone 1. However, in some implementations, any one of the groups of upper intermediate crown facets 16A, 16B, 16C can have the same size and shape as any of the other groups of upper intermediate crown facets 16A, 16B, 16C.

Eight star facets 14A, 14B are disposed between the major, minor, and median upper intermediate crown facets 16A, 16B, 16C, and the table 12. Each star facet 14A, 14B is disposed adjacent to and abutting an edge of the table 12.

Relative to the plane of FIG. 2, the major star facets 14A are disposed either to the left or to the right on the crown 10 along the major axis $A_1$. The major star facets 14A are divided into two groups of two major star facets 14A. A left group of two major star facets 14A is generally disposed along the left side of the major axis $A_1$, which is to the left of the minor axis $A_2$. A right group of two major star facets 14A is generally disposed along the right side of the major axis $A_1$, which is to the right of the minor axis $A_2$.

The major star facets 14A within the left group of major star facets 14A extend generally vertically relative to the plane of FIG. 2. In this manner, the two major star facets 14A within the left group of major star facets 14A are aligned along an axis that is parallel to and to the left of the minor axis $A_2$. Similarly, the major star facets 14A within the right group of major star facets 14A also extend generally vertically relative to the plane of FIG. 2. In this manner, the two major star facets 14A within the right group of major star facets 14A are aligned along an axis that is parallel to and to the right of the minor axis $A_2$. The left group of two major star facets 14A thus includes a top-left major star facet 14A and a bottom-left major star facet 14A. The right group of two major star facets 14A thus includes a top-right major star facet 14A and a bottom-right major star facet 14A.

Relative to the plane of FIG. 2, the minor star facets 14B are disposed either toward the top of the crown 10 or toward the bottom of the crown 10, along the minor axis $A_2$. The minor star facets 14B are divided into two groups of two minor star facets 14B. A top group of two minor star facets 14B is generally disposed along the top side of the minor axis $A_2$, which is above the major axis $A_1$. A bottom group of two minor star facets 14B is generally disposed along the bottom side of the minor axis $A_2$, which is below the major axis $A_1$.

The minor star facets 14B within the top group of minor star facets 14B extend generally horizontally relative to the plane of FIG. 2. In this manner, the two minor star facets 14B within the top group of minor star facets 14B are aligned along an axis that is parallel to and above the major axis $A_1$. Similarly, the minor star facets 14B within the bottom group of minor star facets 14B also extend generally horizontally relative to the plane of FIG. 2. In this manner, the two minor star facets 14B within the bottom group of minor star facets 14B are aligned along an axis that is parallel to and below the major axis $A_1$. The top group of two minor star facets 14B thus includes a top-left minor star facet 14B and a top-right minor star facet 14B. The bottom group of two minor star facets 14B thus includes a bottom-left minor star facet 14B and a bottom-right minor star facet 14A.

The top-right major and minor star facets 14A, 14B are disposed generally in the first quadrant 11A of the crown 10. The top-left major and minor star facets 14A, 14B are disposed generally in the second quadrant 11B of the crown 10. The bottom-left major and minor star facets 14A, 14B are disposed generally in the third quadrant 11C of the crown 10. The bottom-right major and minor star 14A, 14B are disposed generally in the fourth quadrant 11D of the crown 10.

Each major star facet 14A is positioned between a major upper intermediate crown facet 16A, a median upper intermediate crown facet 16C, and the table 12. Each minor star facet 14B is positioned between a minor upper intermediate crown facet 16B, a median upper intermediate crown facet 16C, and the table 12.

All of the major and minor star facets 14A, 14B are generally triangle-shaped with three vertices and three edges. A first vertex of each of the major star facets 14A abuts the upper vertex of one of the major lower intermediate crown facets 18A, a lateral vertex of one of the major upper intermediate crown facets 16A, and a lateral vertex of one of the median upper intermediate crown facets 16C. A second vertex of each of the major star facets 14A abuts a vertex of an adjacent major star facet 14A, the upper vertex of one of the major upper intermediate crown facets 16A, and a vertex of the table 12. A third vertex of each of the major star facets 14A abuts a vertex of an adjacent minor star facet 14B, the upper vertex of one of the median upper intermediate crown facets 16C, and a vertex of the table 12. A first edge of each major star facet 14A is shared with one edge of one of the major upper intermediate crown facets 16A. A second edge of each major star facet 14A is shared with one edge of one of the median upper intermediate crown facets 16C. A third edge of each major star facet 14A is shared with the table 12.

A first vertex of each of the minor star facets 14B abuts the upper vertex of one of the minor lower intermediate crown facets 18B, a lateral vertex of one of the minor upper intermediate crown facets 16B, and a lateral vertex of one of the median upper intermediate crown facets 16C. A second vertex of each of the minor star facets 14B abuts a vertex of an adjacent major star facet 14A, the upper vertex of one of the median upper intermediate crown facets 16C, and a vertex of the table 12. A third vertex of each of the minor star facets 14B abuts a vertex of an adjacent minor star facet 14B, the upper vertex of one of the minor upper intermediate crown facets 16B, and a vertex of the table 12. A first edge of each minor star facet 14B is shared with one edge of one of the minor upper intermediate crown facets 16B. A second edge of each minor star facet 14B is shared with one edge of one of the median upper intermediate crown facets 16C. A third edge of each minor star facet 14B is shared with the table 12.

The major star facets 14A generally have a different shape as compared to the minor star facets 14B. The distance between the edge shared with the table 12 and the first vertex (e.g., the vertex opposite the edge shared with the table 12) for the major star facets 14A is generally greater than the distance between the edge shared with the table 12 and the first vertex for the minor star facets 14B. Thus, the minor star facets 14B can be said to be generally flattened toward the table 12 as compared to the major star facets 14A. However, in some implementations, the major star facets 14A have the same general size and shape as the minor star facets 14.

The table 12 is a generally horizontal surface having a number of edges and is located at the top of the crown 10. In the implementation illustrated in FIG. 2, table 12 has a generally octagonal shape. In this implementation, four edges of the table 12 are shared with the major star facets 14A, and the other four edges of the table 12 are shared with the minor star facets 14B. Other shapes for table 12 are contemplated in other implementations. As is shown in FIG. 2, the table 12 has a generally longer dimension along the major axis $A_1$, and a generally shorter dimension along the minor axis $A_2$.

Figure 3:
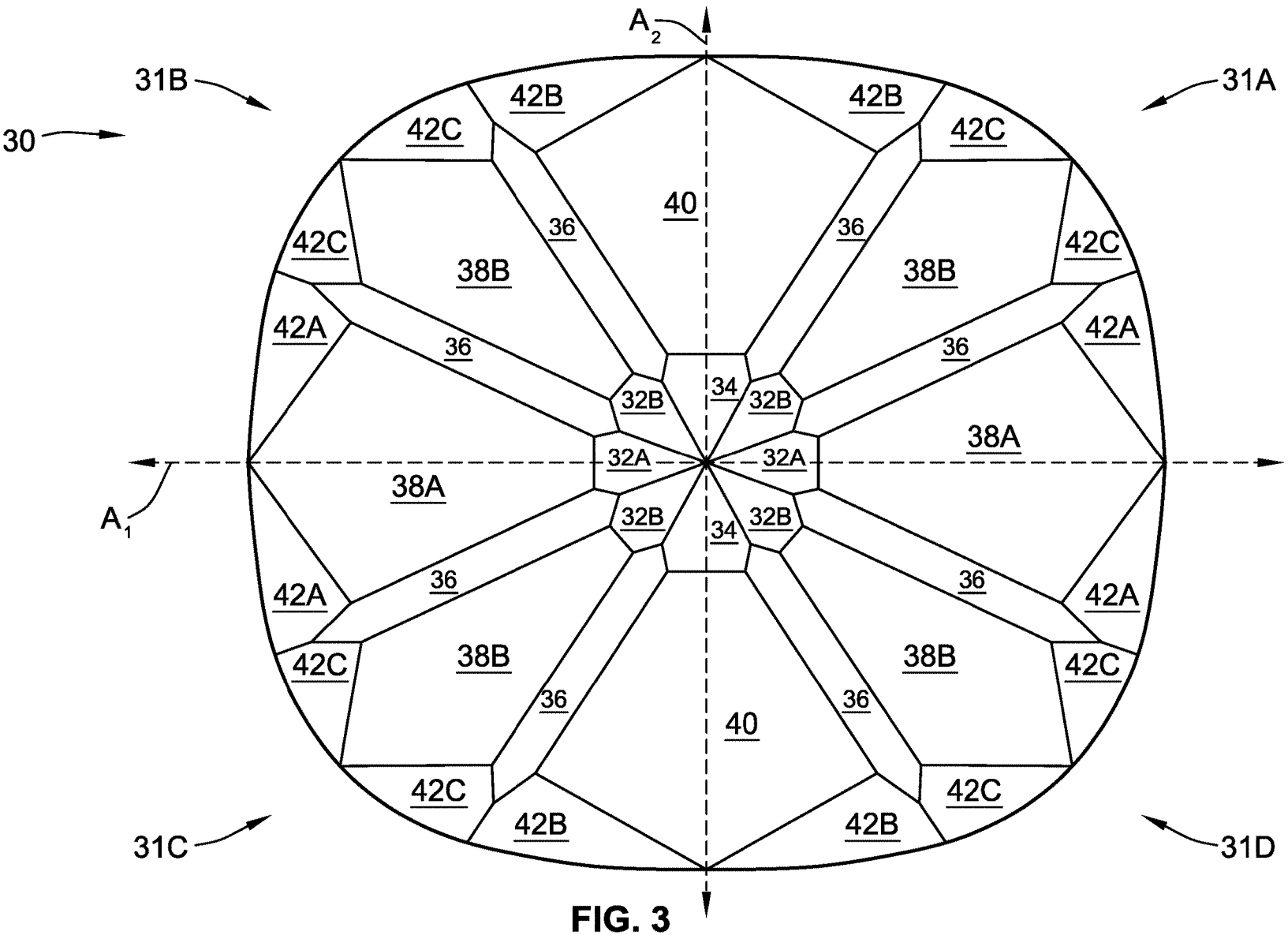
FIG. 3 is a bottom plan view of the gemstone of FIGS. 1A and 1B, according to some implementations of the present disclosure.

Referring now to FIG. 3, a bottom plan view of the gemstone 1 showing the pavilion 30 is illustrated. The major axis $A_1$ of the perimeter of the gemstone (which is formed by the girdle 50) extends horizontally relative to the plane of FIG. 3, while the minor axis $A_2$ extends vertically relative to the plane of FIG. 3. The major and minor axes $A_1$ and $A_2$ generally divide the facets of the pavilion 30 into a first quadrant 31A, a second quadrant 31B, a third quadrant 31C, and fourth quadrant 31D. The first quadrant 31A generally corresponds to the top-right corner region of the pavilion 30 relative to the plane of FIG. 3. The second quadrant 31B generally corresponds to the top-left corner region of the pavilion 30 relative to the plane of FIG. 3. The third quadrant 31C generally corresponds to the bottom-left corner region of the pavilion 30 relative to the plane of FIG. 3. The fourth quadrant 31D generally corresponds to the bottom-right corner region of the pavilion 30 relative to the plane of FIG. 3.

The terms "top," "bottom," "left," "right," "above," below," etc. are used herein to refer to the locations of the various facets on the pavilion 30. However, those of skill in the art will understand that these are relative terms that are generally used in reference to the plane of FIG. 3. Thus, any of these terms used to describe an individual facet may not apply when viewing the pavilion 30 from a different perspective. The facets on the surface of the pavilion 30 share edges and vertices where the facets meet. The facets on the surface of the pavilion 30 share edges and vertices where the facets meet. When describing the facets on the surface of the pavilion 30, the term "lower" is used to refer to edges or vertices nearer to the lower point 33 (see FIGS. 1A and 1B), while the term "upper" is used to refer to edges or vertices nearer to the girdle 50.

The pavilion 30 includes a number of main pavilion facets, which include six major main pavilion facets 38A, 38B, and two minor main pavilion facets 40. Relative to the plane of FIG. 3, the six major main pavilion facets 38A, 38B are generally disposed either to the left or to the right along the major axis $A_1$. The major main pavilion facets 38A, 38B are divided into two groups of three major main pavilion facets 38A, 38B. A left group of three major main pavilion facets 38A, 38B is generally disposed along the left side of the major axis $A_1$, which is to the left of the minor axis $A_2$. A right group of three major main pavilion facets 38A, 38B is generally disposed along the right side of the major axis $A_1$, which is to the right of the minor axis $A_2$.

The major main pavilion facets 38A, 38B within the left group of major main pavilion facets 38A, 38B extend generally vertically relative to the plane of FIG. 3. In this manner, the three major main pavilion facets 38A, 38B within the left group of major main pavilion facets 38A, 38B are aligned along an axis that is parallel to and to the left of the minor axis $A_2$. Similarly, the major main pavilion facets 38A, 38B within the right group of major main pavilion facets 38A, 38B also extend generally vertically relative to the plane of FIG. 3. In this manner, the three major main pavilion facets 38A, 38B within the right group of major main pavilion facets 38A, 38B are aligned along an axis that is parallel to and to the right of the minor axis $A_2$.

Each group of three major main pavilion facets includes a central major main pavilion facet 38A surrounded by two outer major main pavilion facets 38B. The two central major main pavilion facets 38A (e.g. the left and right central major main pavilion facets 38A relative to the plane of FIG. 3) are generally aligned along the major axis $A_1$. The left central major main pavilion facet 38A extends into both the second quadrant 31B and the third quadrant 31C. The right central major main pavilion facet 38A extends into both the first quadrant 31A and the fourth quadrant 31D.

Relative to the plane of FIG. 3, the two outer major main pavilion facets 20B above the central major main pavilion facets 38A (e.g., the top-right and top-left major main pavilion facets 38B) are aligned along a line parallel to and above the major axis $A_1$. Similarly, relative to the plane of FIG. 3, the two outer major main crown facets 38B below the central major main pavilion facets 38A (e.g., the bottom-left and bottom-right major main pavilion facets 38B) are aligned along a line parallel to and below the major axis $A_1$. The top-right major main pavilion facet 38B is disposed in the first quadrant 31A. The top-left major main pavilion facet 38B is disposed in the second quadrant 31B. The bottom-left major main pavilion facet 38B is disposed in the third quadrant 31C. The bottom-right major main pavilion facet 38B is disposed in the fourth quadrant 31D. Generally, at least a first portion of each of the major main pavilion facets 38A, 38B is disposed between two of the candle facets 36. At least a second portion of each of the central major main pavilion facets 38A is disposed between two of the major lower girdle facets 42A. At least a second portion of each of the outer major main pavilion facets 38B is disposed between two of the median lower girdle facets 42C.

The two minor main pavilion facets 40 are generally aligned along the minor axis $A_2$. Relative to the plane of FIG. 3, one of the minor main pavilion facets 40 (e.g., the top minor main pavilion facet 40) is generally disposed along the top side of the minor axis $A_2$, which is above the major axis $A_1$. The other minor main pavilion facet 40 (e.g., the bottom minor pavilion facet 40) is disposed along the bottom side of the minor axis $A_2$, which is below the major axis $A_1$. The top minor main pavilion facet 40 generally extends into both the first quadrant 31A and the second quadrant 31B. The bottom minor main pavilion crown facet 40 generally extends into both the third quadrant 31C and the fourth quadrant 31D. Generally, at least a first portion of each of the minor main pavilion facets 40 is disposed between two of the candle facets 36, while at least a second portion of each of the minor main pavilion facets 40 is disposed between two of the minor lower girdle facets 42B.

Each major main pavilion facet 38A, 38B is generally diamond or kite-shaped with a flattened lower edge. Thus, each major main pavilion facet 38A, 38B has a pentagon shape with five edges. The major main pavilion facets 38A, 38B thus have one upper vertex, two lower vertices, and two lateral vertices. The upper vertex of each major main pavilion facet 38A, 38B abuts the lower edge of the girdle. Similarly, each minor main pavilion facet 40 is generally diamond or kite-shaped with a flattened lower edge. Thus, each minor main pavilion facet 40 has a pentagon shape with five edges. The minor main pavilion facets 40 thus have an upper vertex, two lower vertices, and two lateral vertices. The upper vertex of each minor main pavilion facet 40 abuts the lower edge of the girdle.

Each central major main pavilion facet 38A thus shares first and second edges with two adjacent major lower girdle facets 42A, third and fourth edges with two adjacent candle facets 36, and a fifth edge (the lower edge) with the upper edge of a single corresponding central major culet-adjacent facet 32A. Each outer major main pavilion facet 38B shares first and second edges with two adjacent median lower girdle facets 42C, third and fourth edges with two adjacent candle facets 36, and a fifth edge (the lower edge) with the upper edge of a single corresponding outer major culet-adjacent facet 34B. Each minor main pavilion facet 40 shares first and second edges with two adjacent minor lower girdle facets 42B, third and fourth edges with two adjacent candle facets 36, and a fifth edge (the lower edge) with the upper edge of a single corresponding minor culet-adjacent facet 34.

The two lateral vertices of each central major main pavilion facet 38A, each outer major main pavilion facet 38B, and each minor main pavilion facet 40 abut vertices of adjacent candle facets 36. The two lower vertices of each of the central major main pavilion facets 38A and all of the outer major main pavilion facets 38B each abut a vertex of an adjacent candle facet 36 and a vertex of the single corresponding major culet-adjacent facet 32. The two lower vertices of the minor main pavilion facets 40 each abut a vertex of an adjacent candle facet 36 and a vertex of the single corresponding minor culet-adjacent facet 34.

The upper vertex of each of the outer major main pavilion facets 38B is generally shifted toward the nearest central major main pavilion facet 38A, and away from the nearest minor main pavilion facet 40. In this manner, the angle bisector of the upper vertex of the outer major main pavilion facets 38B is generally not perpendicular to the corresponding flattened lower edge of the same outer major main pavilion facet 38B. In contrast, the upper vertex of the central major main pavilion facets 38A is not shifted, and thus the angle bisectors of the upper vertex of the central major main pavilion facets 38A are generally parallel to the corresponding flattened lower edge of the same central major main pavilion facet 38A.

Thus, while all of the central and outer major main pavilion facets 38A, 38B generally have the same angle or an angle within the same range, the central and outer major main pavilion facets 38A, 38BB can have slightly differ different shapes depending on their location along the pavilion 30 of the gemstone 1. However, in some implementations, any one of the groups of main pavilion facets 38A, 38B, 40 can have the same size and shape as any of the other groups of main pavilion facets 38A, 38B, 40.

The pavilion 30 includes four major lower girdle facets 42A, four minor lower girdle facets 42B, and eight median lower girdle facets 42C. Relative to the plane of FIG. 3, the four major lower girdle facets 42A are disposed either to the left or to the right on the pavilion 30 along the major axis $A_1$. The major lower girdle facets 42A are divided into two groups of two major lower girdle facets 42A. A left group of two major lower girdle facets 42A is generally disposed along the left side of the major axis $A_1$, which is to the left of the minor axis $A_2$. A right group of two major lower girdle facets 42A is generally disposed along the right side of the major axis $A_1$, which is to the right of the minor axis $A_2$. The major lower girdle facets 42A within the left group of major lower girdle facets 42A extend generally vertically relative to the plane of FIG. 3. In this manner, the two major lower girdle facets 42A within the left group of major lower girdle facets 42A are aligned along an axis that is parallel to and to the left of the minor axis $A_2$. Similarly, the major lower girdle facets 42A within the right group of major lower girdle facets 42A also extend generally vertically relative to the plane of FIG. 3. In this manner, the two major lower girdle facets 42A within the right group of major lower girdle facets 42A are aligned along an axis that is parallel to and to the right of the minor axis $A_2$.

One major lower girdle facet 42A of the right group of major lower girdle facets 42A is disposed generally in the first quadrant 31A of the pavilion 30. The other major lower girdle facet 42A of the right group of major lower girdle facets 42A is disposed generally in the fourth quadrant 31D of the pavilion 30. One major lower girdle facet 42A of the left group of major lower girdle facets 42A is disposed generally in the second quadrant 31B of the pavilion 30. The other major lower girdle facet 42A of the left group of major lower girdle facets 42A is disposed generally in the third quadrant 31C of the pavilion 30.

Relative to the plane of FIG. 3, the four minor lower girdle facets 42B are disposed either toward the top of the pavilion 30, or toward the bottom of the pavilion 30, along the minor axis $A_2$. The minor lower girdle facets 42B are divided into two groups of two minor lower girdle facets 42B. A top group of two minor lower girdle facets 42B is generally disposed along the top side of the minor axis $A_2$, which is above the major axis $A_1$. A bottom group of two minor lower girdle facets 42B is generally disposed along the bottom side of the minor axis $A_2$, which is below the major axis $A_1$. The minor lower girdle facets 42B within the top group of minor lower girdle facets 42B extend generally horizontally relative to the plane of FIG. 3. In this manner, the two minor lower girdle facets 42B within the top group of minor lower girdle facets 42B are aligned along an axis that is parallel to and above the major axis $A_1$. Similarly, the minor lower girdle facets 42B within the bottom group of minor lower girdle facets 42B also extend generally horizontally relative to the plane of FIG. 3. In this manner, the two minor lower girdle facets 42B within the bottom group of minor lower girdle facets 42B are aligned along an axis that is parallel to and below the major axis $A_1$.

One minor lower girdle facet 42B of the top group of minor lower girdle facets 42B is disposed generally in the first quadrant 31A of the pavilion 30. The other minor lower girdle facet 42B of the top group of minor lower girdle facets 42B is disposed generally in the second quadrant 31B of the pavilion 30. One minor lower girdle facet 42B of the bottom group of minor lower girdle facets 42B is disposed generally in the third quadrant 31C of the pavilion 30. The other minor lower girdle facet 42B of the bottom group of minor lower girdle facets 42B is disposed generally in the fourth quadrant 31D of the pavilion 30.

Relative to the plane of FIG. 3, the eight median lower girdle facets 42C are generally positioned diagonally relative to the major axis $A_1$ and the minor axis $A_2$. The median lower girdle facets 42C are divided into four groups of two median lower girdle facets 42C. A top-right group of median lower girdle facets 42C is positioned in the first quadrant 31A, above the major axis $A_1$ and to the right of the minor axis $A_2$. A top-left group of median lower girdle facets 42C is positioned in the second quadrant 31B, above the major axis $A_1$ and to the left of the minor axis $A_2$. A bottom-left group of median lower girdle facets 42C is positioned in the third quadrant 31C, below the major axis $A_1$ and to the left of the minor axis $A_2$. A bottom-right group of median lower girdle facets 42C is positioned in the fourth quadrant 31D, below the major axis $A_1$ and to the right of the minor axis $A_2$.

Each of the major lower girdle facets 42A is disposed between one of the central major main pavilion facets 38A, an adjacent one of the candle facets 36, and the lower edge of the girdle 50. Each of the major lower girdle facets 42A has a generally triangular shape. A first edge of each of the major lower girdle facets 42A is shared with the girdle 50, and can be flat or curved depending on the shape of the girdle 50. A second edge of each of the major lower girdle facets 42A is shared with one of the central major main pavilion facets 38A.

As shown, each of the major lower girdle facets 42A shares a third edge with an adjacent one of the median lower girdle facets 42C. One of the left group of major lower girdle facets 42A shares its third edge with one of the top-left median lower girdle facets 42C. The other of the left group of major lower girdle facets 42A shares its third edge with one of the bottom-left median lower girdle facets 42C. One of the right group of major lower girdle facets 42A shares its third edge with one of the top-right median lower girdle facets 42C. The other of the right group of major lower girdle facets 42A shares its third edge with one of the bottom-right median lower girdle facets 42C. Thus, each major lower girdle facet 42A is part of a pair of lower girdle facets along with its corresponding median lower girdle facet 42C. The upper portions of each pair of major and median lower girdle facets 42A, 42C form a gap into which an upper portion of one of the candle facets 36 extends.

The minor lower girdle facets 42B are disposed in a similar fashion as the major lower girdle facets 42A. Each of the minor lower girdle facets 42B is disposed between one of the minor main pavilion facets 40, an adjacent one of the candle facets 36, and the lower edge of the girdle 50. Each of the minor lower girdle facets 42B has a generally triangular shape. A first edge of each of the minor lower girdle facets 42B is shared with the girdle 50, and can be flat or curved depending on the shape of the girdle 50. A second edge of each of the minor lower girdle facets 42B is shared with one of the minor main pavilion facets 40

As shown, each of the minor lower girdle facets 42B shares a third edge with an adjacent one of the median lower girdle facets 42C. One of the top group of minor lower girdle facets 42B shares its third edge with one of the top-left median lower girdle facets 42C. The other of the top group of minor lower girdle facets 42B shares its third edge with one of the top-right median lower girdle facets 42C. One of the bottom group of minor lower girdle facets 42B shares its third edge with one of the bottom-left median lower girdle facets 42C. The other of the bottom group of minor lower girdle facets 42B shares its third edge with one of the bottom-right median lower girdle facets 42C. Thus, each minor girdle facet 42B is part of a pair of lower girdle facets along with its corresponding median lower girdle facet 42C. The upper portions of each pair of minor and median lower girdle facets 42B, 42C form a gap into which an upper portion of one of the candle facets 36 extends.

Each of the median crown facets 16C is disposed between the lower edge of the girdle, one of the outer major main pavilion facets 38B, and an adjacent one of the candle facets 36. Each of the median lower girdle facets 42C has a generally triangular shape. A first edge of each of the median lower girdle facets 42C is shared with the girdle 50, and can be flat or curved depending on the shape of the girdle 50. A second edge of each of the median lower girdle facets 42C is shared with one of the outer major main pavilion facets 38B.

As shown, each of the minor lower girdle facets 42B shares a third edge with either (i) an adjacent one of the major lower girdle facets 42A, or (ii) an adjacent one of the minor lower girdle facets 42B. One of the top-right group of median lower girdle facets 42C shares its third edge with one of the right group of major lower girdle facets 42A. The other of the top-right group of median lower girdle facets 42C shares its third edge with one of the top group of minor lower girdle facets 42B. One of the top-left group of median lower girdle facets 42C shares its third edge with one of the top group of minor lower girdle facets 42B. The other of the top-left group of median lower girdle facets 42C shares its third edge with one of the left group of major lower girdle facets 42A. One of the bottom-left group of median lower girdle facets 42C shares its third edge with one of the left group of major lower girdle facets 42A. The other of the bottom-left group of median lower girdle facets 42C shares its third edge with one of the bottom group of minor lower girdle facets 42B. One of the bottom-right group of median lower girdle facets 42C shares its third edge with one of the bottom group of minor lower girdle facets 42B. The other of the bottom-right group of median lower girdle facets 42C shares its third edge with one of the right group of major lower girdle facets 42A. Thus, each median lower girdle facet 42C is part of a pair of lower girdle facets along with either its corresponding major lower girdle facet 42A or its corresponding minor lower girdle facet 42B.

Each of the major, minor, and median lower girdle facets 42A, 42B, 42C has two upper vertices, a lower vertex, and a lateral vertex. Each of the two upper vertices of each respective lower girdle facet abuts both (i) the lower edge of the girdle and (ii) an upper vertex of an adjacent one of the lower girdle facets 42A, 42B, 42C. For the major lower girdle facets 42A, one of the upper vertices abuts an upper vertex of the other major lower girdle facet 42A in the same group (e.g., left or right). The other upper vertex abuts an upper vertex of an adjacent one of the median lower girdle facets 42C. For the minor lower girdle facets 42B, one of the upper vertices abuts an upper vertex of the other minor lower girdle facet 42B in the same group (e.g. top or bottom). The other upper vertex abuts an upper vertex of an adjacent one of the median lower girdle facets 42C. For the median lower girdle facets 42C, one of the upper vertices abuts an upper vertex of the other minor lower girdle facet 42B in the same group (e.g., top-right, top-left, bottom-left, or bottom-right). The other upper vertex abuts an upper vertex of either (i) one of the major lower girdle facets 42A or (ii) one of the minor lower girdle facets 42B.

The lower vertex of each major lower girdle facet 42A abuts a vertex of one of the central main pavilion facets 38A, and one of the candle facets 36. The lower vertex of each minor lower girdle facet 42B abuts a vertex of one of the minor pavilion facets 40, and one of the candle facets 36. The lower vertex of each median lower girdle facet 42C abuts a vertex of one of the outer main pavilion facets 38B, and one of the candle facets 36.

The lateral vertex of each major lower girdle facet 42A abuts a vertex of one of the candle facets 36 and an adjacent one of the median lower girdle facets 42C. The lateral vertex of each minor lower girdle facet 42B abuts a vertex of one of the candle facets 36 and an adjacent one of the median lower girdle facets 42C. The lateral vertex of each median lower girdle facet 42C abuts a vertex of one of the candle facets 36 and either (i) an adjacent one of the major lower girdle facets 42A, or (ii) an adjacent one of the minor lower girdle facets 42B.

In the illustrated implementation, the upper edge of each major and minor lower girdle facet 42A, 42B that abuts the lower edge of the girdle is larger than the upper edge of each median lower girdle facet 42C that abuts the lower edge of the girdle. Thus, the major and minor lower girdle facets 42A, 42B are generally larger than the median lower girdle facets 42C. However, in other implementations, the upper edge of each major and minor lower girdle facet 42A, 42B is generally the same length as the upper edge of each median lower girdle facet 42C, such that all of the major, minor, and median lower girdle facets 42A, 42B, 42C are the same size.

Eight culet-adjacent facets are formed at the lowermost portion of the pavilion 30, which includes six major culet-adjacent facets 32A, 32B, and two minor culet-adjacent facets 34. Each culet-adjacent facet 32A, 32B, 34 has a generally pentagonal shape with a lower vertex, two lateral vertices, and two upper vertices. An upper flat edge is opposite the lower vertex of each culet-adjacent facet 32A, 32B, 34. In some implementations, the major and minor culet-adjacent facets 32A, 32B, 34 terminate in a culet, which is a horizontal surface forming the bottom of the pavilion 30. In the implementation illustrated in FIG. 3, each of the major and minor culet-adjacent facets 32A, 32B, 34 has a bottom vertex. Together, the bottom vertices of each of the major and minor culet-adjacent facets 32A, 32B, 34 form the lower point 33 of the gemstone 1 (see FIGS. 1A and 1B).

Relative to the plane of FIG. 3, the six major culet-adjacent facets 32A, 32B are generally disposed either to the left or to the right along the major axis $A_1$. The major culet-adjacent facets 32A, 32B are divided into two groups of three major culet-adjacent facets 32A, 32B. A left group of three major culet-adjacent facets 32A, 32B is generally disposed along the left side of the major axis $A_1$, which is to the left of the minor axis $A_2$. A right group of three major culet-adjacent facets 32A, 32B is generally disposed along the right side of the major axis $A_1$, which is to the right of the minor axis $A_2$.

The major culet-adjacent facets 32A, 32B within the left group of major culet-adjacent facets 32A, 32B extend generally vertically relative to the plane of FIG. 3. In this manner, the three major culet-adjacent facets 32A, 32B within the left group of major culet-adjacent facets 32A, 32B are aligned along an axis that is parallel to and to the left of the minor axis $A_2$. Similarly, the major culet-adjacent facets 32A, 32B within the right group of major culet-adjacent facets 32A, 32B also extend generally vertically relative to the plane of FIG. 3. In this manner, the three major culet-adjacent facets 32A, 32B within the right group of major culet-adjacent facets 32A, 32B are aligned along an axis that is parallel to and to the right of the minor axis $A_2$.

Each group of three major culet-adjacent facets 32A, 32B includes a central major culet-adjacent facet 32A surrounded by two outer major culet-adjacent facets 32B. The two central major culet-adjacent facets 32A (e.g. the left and right central major culet-adjacent facets 32A relative to the plane of FIG. 3) are generally aligned along the major axis $A_1$. The left central major culet-adjacent facet 32A extends into both the second quadrant 31B and the third quadrant 31C. The right central major culet-adjacent facet 32A extends into both the first quadrant 31A and the fourth quadrant 31D.

Relative to the plane of FIG. 3, the two outer major culet-adjacent facets 32B above the central major culet-adjacent facets 32A (e.g., the top-right and top-left major culet-adjacent facets 32B) are aligned along a line parallel to and above the major axis $A_1$. Similarly, relative to the plane of FIG. 3, the two outer major culet-adjacent facets 32B below the central major culet-adjacent facets 32A (e.g., the bottom-left and bottom-right major culet-adjacent facets 32B) are aligned along a line parallel to and below the major axis $A_1$.

The top-right major culet-adjacent facet 32B is disposed in the first quadrant 31A. The top-left major culet-adjacent facet 32B is disposed in the second quadrant 31B. The bottom-left major culet-adjacent facet 32B is disposed in the third quadrant 31C. The bottom-right major culet-adjacent facet 32B is disposed in the fourth quadrant 31D. Generally, at least an upper portion of each of the major main culet-adjacent facets 32A, 32B is disposed between two of the candle facets 36.

The two minor culet-adjacent facets 34 are generally aligned along the minor axis $A_2$. Relative to the plane of FIG. 3, one of the minor culet-adjacent facets 34 (e.g., the top minor culet-adjacent facet 34) is generally disposed along the top side of the minor axis $A_2$, which is above the major axis $A_1$. The other minor culet-adjacent facet 34 (e.g., the bottom minor culet-adjacent facet 34) is disposed along the bottom side of the minor axis $A_2$, which is below the major axis $A_1$. The top minor culet-adjacent facet 34 generally extends into both the first quadrant 31A and the second quadrant 31B. The bottom minor culet-adjacent facet 34 generally extends into both the third quadrant 31C and the fourth quadrant 31D. Generally, at least an upper portion of each of the minor main pavilion facets 40 is disposed between two of the candle facets 36.

The two lateral vertices of the central major culet-adjacent facets 32A each abut a lower vertex of an adjacent candle facet 36 and a lateral vertex of an adjacent outer major culet-adjacent facet 32B. The two upper vertices of the central major culet-adjacent facets 32A each abut a vertex of an adjacent candle facet 36 and a lower vertex of the adjacent major central main pavilion facet 38A. Each central major culet-adjacent facet 32A shares two edges with two adjacent outer major culet-adjacent facets 32B, two edges with two adjacent candle facets 36, and one edge with an adjacent central major main pavilion facet 38A.

The two lateral vertices of the outer major culet-adjacent facets 32B abut a vertex of an adjacent candle facet 36, and either (i) a lateral vertex of the adjacent central major culet-adjacent facet 32A or (ii) a lateral vertex of the adjacent minor culet-adjacent facet 34. The two upper vertices of the outer major culet-adjacent facets 32B each abut a vertex of an adjacent candle facet 36 and a lower vertex of the adjacent major outer main pavilion facet 38B. Each outer major culet-adjacent facet 32B shares one edge with an adjacent central major culet-adjacent facet 32A, one edge with an adjacent minor culet-adjacent facet 34, two edges with two adjacent candle facets 36, and one edge with an adjacent outer major main pavilion facet 38B.

The two lateral vertices of the minor culet-adjacent facets 34 abut a vertex of an adjacent candle facet 36 and a lateral vertex of an adjacent outer major culet-adjacent facet 32B. The two upper vertices of the minor culet-adjacent facets 34 each abut a vertex of an adjacent candle facet 36 and a lower vertex of the adjacent minor central main pavilion facet 40. Each minor culet-adjacent facet 34 shares two edges with two adjacent outer major culet-adjacent facets 32B, two edges with two adjacent candle facets 36, and one edge with an adjacent minor main pavilion facet 40.

Due to the oval or elliptical shape of the gemstone 1, the major and minor culet-adjacent facets 32A, 32B, 34 have slightly different shapes. Generally, the distance between lateral vertices of the minor culet-adjacent facets 34 is larger than the distance between lateral vertices of both the central major culet-adjacent facets 32A and the outer major culet-adjacent facets 32B. The distance between lateral vertices of the central major culet-adjacent facets 32A is larger than the distance between lateral vertices of the outer major culet-adjacent facets 32B. However, in some implementations, any one of the groups of culet-adjacent facets 32A, 32B, 34 can have the same size and shape as any of the other groups of culet-adjacent facets 32A, 32B, 34.

Eight candle facets 36 are formed on the surface of the pavilion 30. Each candle facet 36 is positioned between (i) two of the major and minor main pavilion facets 38A, 38B, 40, (ii) two of the major and minor culet-adjacent facets 32A, 32B, 34, and (iii) either a pair of major and median lower girdle facets 42A, 42C, or a pair of minor and median lower girdle facets 42B, 42C. Each candle facet 36 has six edges and six vertices. Each candle facet shares two edges with two adjacent main pavilion facets (e.g., two of a central major main pavilion facet 38A, an outer major main pavilion facet 38B, and a minor main pavilion facet 40), two edges with two adjacent culet-adjacent facets (e.g., two of a central major culet-adjacent facet 32A, an outer major culet-adjacent facet 32B, and a minor main culet-adjacent facet 34), and two edges with either (i) a pair of the major and median lower girdle facets 42A, 42C, or (ii) a pair of the minor and median lower girdle facets 42B, 42C. A lower portion of each of the candle facets 36, including a bottom point, is disposed between two adjacent culet-adjacent facets 32A, 32B, 34. An upper portion of each of the candle facets 36 is slotted between either (i) a pair of major and median lower girdle facets 42A, 42B, or (ii) a pair of minor and median lower girdle facets 42B, 42C. In the illustrated implementation, two candle facets 36 are positioned in the first quadrant 31A, two candle facets 36 are positioned in the second quadrant 31B, two candle facets 36 are positioned in the third quadrant 31C, and two candle facets 36 are positioned in the fourth quadrant 31D.

Figure 4A:
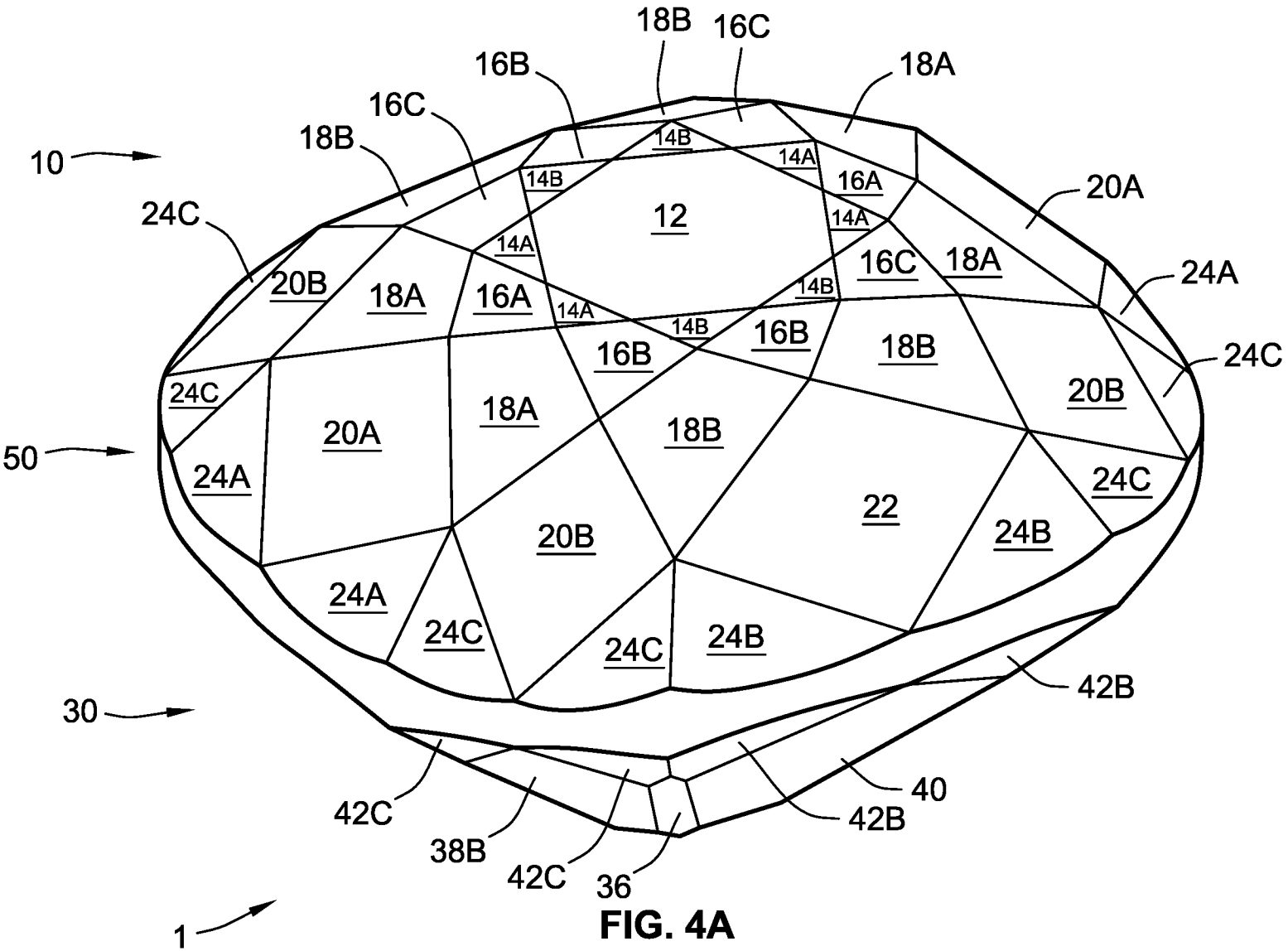
FIG. 4A is a perspective view of the gemstone of FIGS. 1A and 1B viewed at a downward angle, according to some implementations of the present disclosure.
Figure 4B:
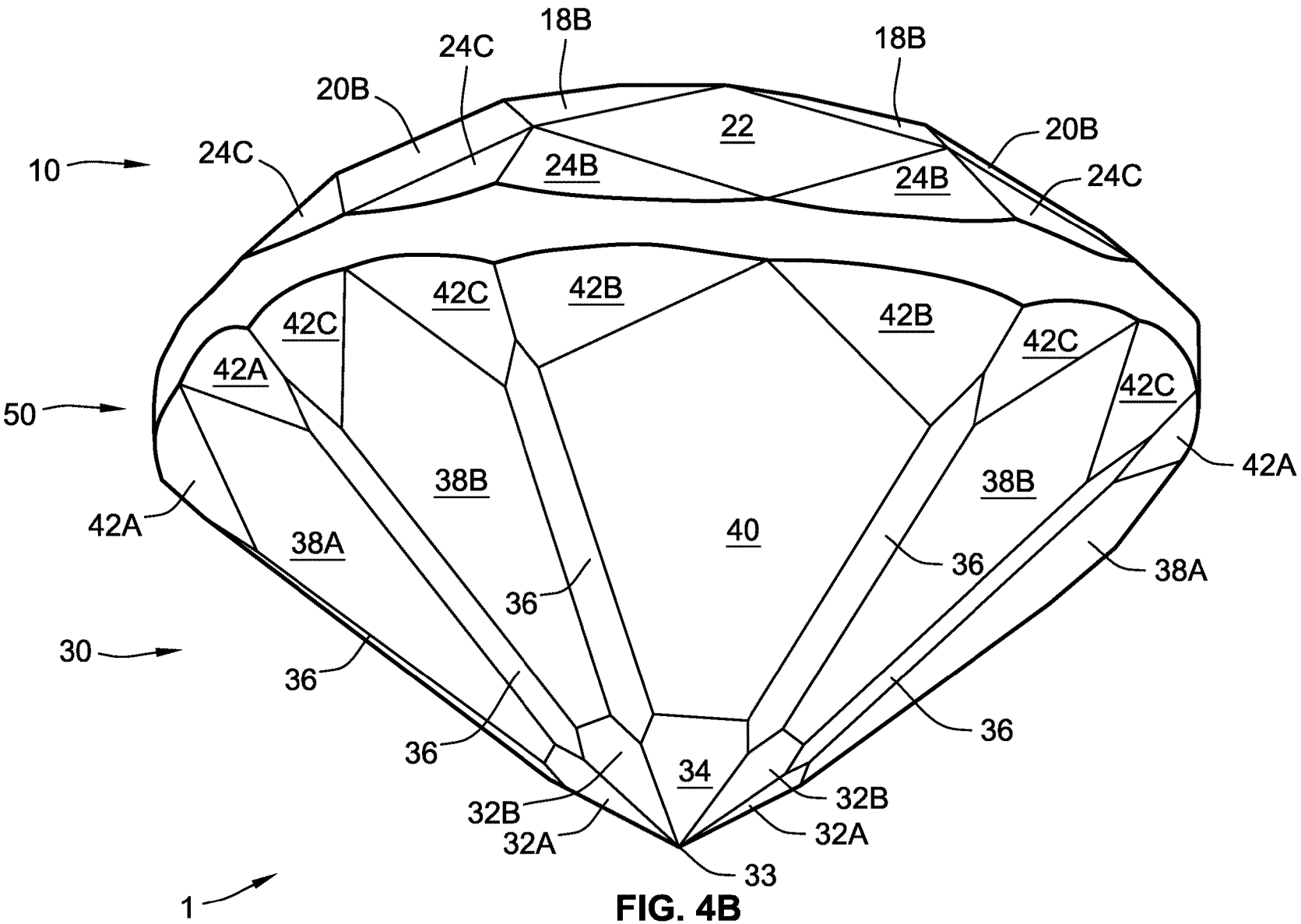
FIG. 4B is a perspective view of the gemstone of FIGS. 1A and 1B viewed at an upward angle, according to some implementations of the present disclosure.

FIG. 4A illustrates a perspective view of gemstone 1 at a downward angle, while FIG. 4B illustrates a perspective view of gemstone 1 at an upward angle. These figures show the table 12, the major star facets 14A, the minor star facets 14B, the major upper intermediate crown facets 16A, the minor upper intermediate crown facets 16B, the median upper intermediate crown facets 16C, the major lower intermediate crown facets 18A, the minor lower intermediate crown facets 18B, the central major main crown facets 20A, the outer major main crown facets 20B, the minor main crown facets 22, the major upper girdle facets 24A, the minor upper girdle facets 24B, the median upper girdle facets 24C, the central major culet-adjacent facets 32A, the outer major culet-adjacent facets 32B, the minor culet-adjacent facets 34, the candle facets 36, the central major main pavilion facets 38A, the outer major main pavilion facets 38B, the minor main pavilion facets 40, the major lower girdle facets 42A, the minor lower girdle facets 42B, the median lower girdle facets 42C, and the girdle 50.

Figure 5A:
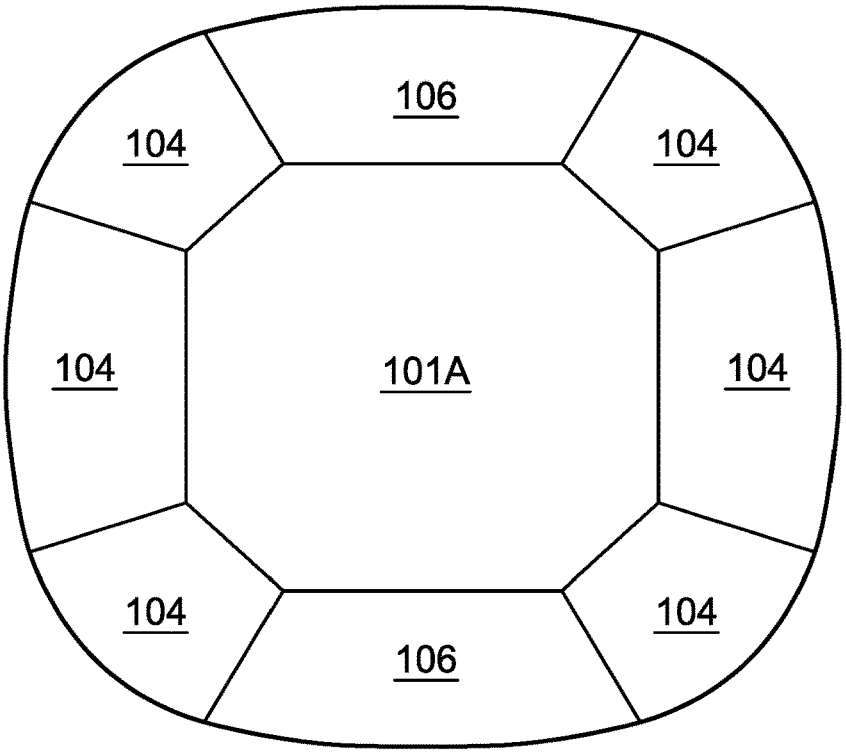
FIG. 5A illustrates a first step of a method of forming a crown of the gemstone of FIGS. 1A and 1B, according to some implementations of the present disclosure.

Referring now to FIGS. 5A-5E, the steps for forming the crown of the gemstone are illustrated. As used in relation to FIGS. 5A-5E, the major axis $A_1$ and the minor axis $A_2$ have the same orientations relative to the gemstone as gemstone 1 in FIGS. 2 and 3, but are not shown. Thus, in FIGS. 5A-5E, the major axis $A_1$ extends horizontally relative to the plane of the figures, while the minor axis $A_2$ extends vertically relative to the plane of the figures. Generally, the gemstone may be formed from an uncut sample, which can have any shape. As shown in FIG. 5A, the first step includes forming a first preliminary table 101A, a first set of crown facets 104 (e.g., a first temporary set of crown facets), and a second set of crown facets 106 (e.g., a second temporary set of crown facets). In an implementation, the width of the first preliminary table 101A is formed to be the same as the table 102 of the final gemstone, and thus is between about 31.5% and about 35.5% of the width of the gemstone, about 30% to about 40% of the width of the gemstone, about 25% to about 45% of the width of the gemstone, or about 33.5% of the width of the gemstone.

The facets of the first set of crown facets 104 are formed at an angle of between about 37° and about 45°. The facets of the first set of crown facets 104 are disposed along the left and right sides of the major axis $A_1$, to the left and right of the minor axis $A_2$. The second set of crown facets 106 are formed at an angle of between about 42° and about 49°. One of the second set of crown facets 106 is disposed along the top side of the minor axis $A_2$, above the major axis $A_1$. The other of the second set of crown facets 106 is disposed along the bottom side of the minor axis $A_2$, below the major axis $A_1$. The angle of the first and second sets of crown facets 104, 106 and the angles of subsequent crown facets formed in subsequent steps are measured relative to the horizontal plane that is defined by the first preliminary table 101A, similar to how the angles of the facets of the completed crown were measured in FIGS. 1A and 1B. After this step, the crown of the gemstone includes the first preliminary table 101A, the first set of crown facets 104, and the second set of crown facets 106.

Figure 5B:
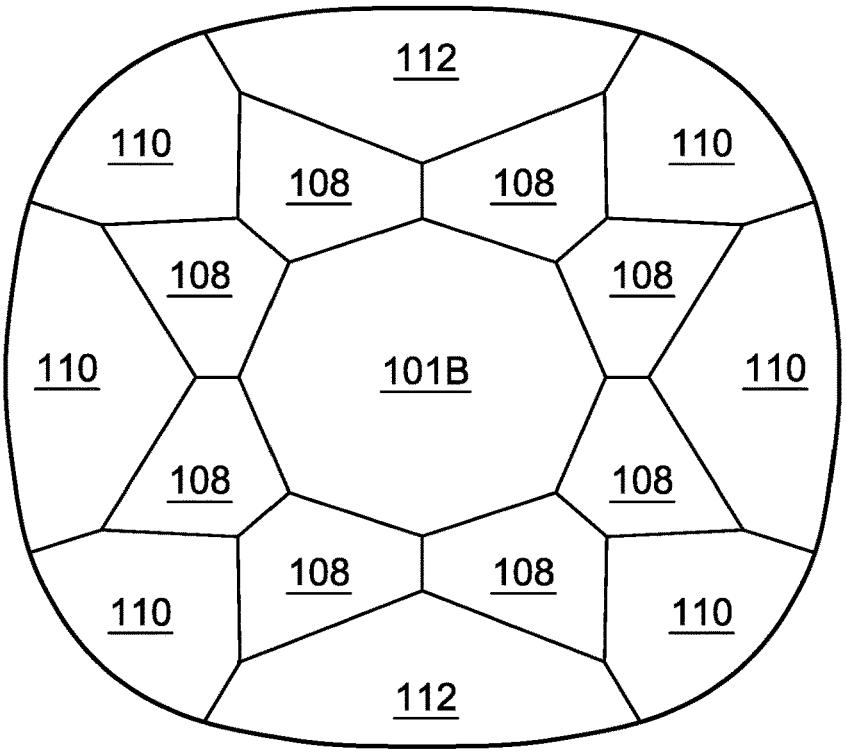
FIG. 5B illustrates a second step of the method of forming the crown of the gemstone of FIGS. 1A and 1B, according to some implementations of the present disclosure.

The next step is shown in FIG. 5B. Here, a third set of crown facets 108 (e.g., a third temporary set of crown facets) is formed on the crown of the gemstone. The third set of crown facets 108 is formed by carving a pentagonal surface out of portions of the first preliminary table, the first set of crown facets 104, and the second set of crown facets 106. The third set of crown facets 108 can be formed at an angle of between about 25° and about 35°. The gemstone after this step is thus left with a second preliminary table 101B, the third set of crown facets 108, a fourth set of crown facets 110, and a fifth set of crown facets 112. The second preliminary table 101B is formed from the remainder of the first preliminary table 101A, and is generally horizontal. The fourth set of crown facets 110 (e.g., a fourth temporary set of crown facets) is formed from the remainder of the first set of crown facets 104, and is formed at the same angle as the first set of crown facets 104. The facets of the fourth set of crown facets 110 are disposed along the left and right sides of the major axis $A_1$, to the left and right of the minor axis $A_2$. The fifth set of crown facets 112 (e.g., a fifth temporary set of crown facets) is formed from the remainder of the second set of crown facets 106, and is formed at the same angle as the second set of crown facets 106. One of the fifth set of crown facets 112 is disposed along the top side of the minor axis $A_2$, above the major axis $A_1$. The other of the fifth set of crown facets 112 is disposed along the bottom side of the minor axis $A_2$, below the major axis $A_1$. After this step, the crown of the gemstone includes the second preliminary table 101B, the third set of crown facets 108, the fourth set of crown facets 110, and the fifth set of crown facets 112.

Figure 5C:
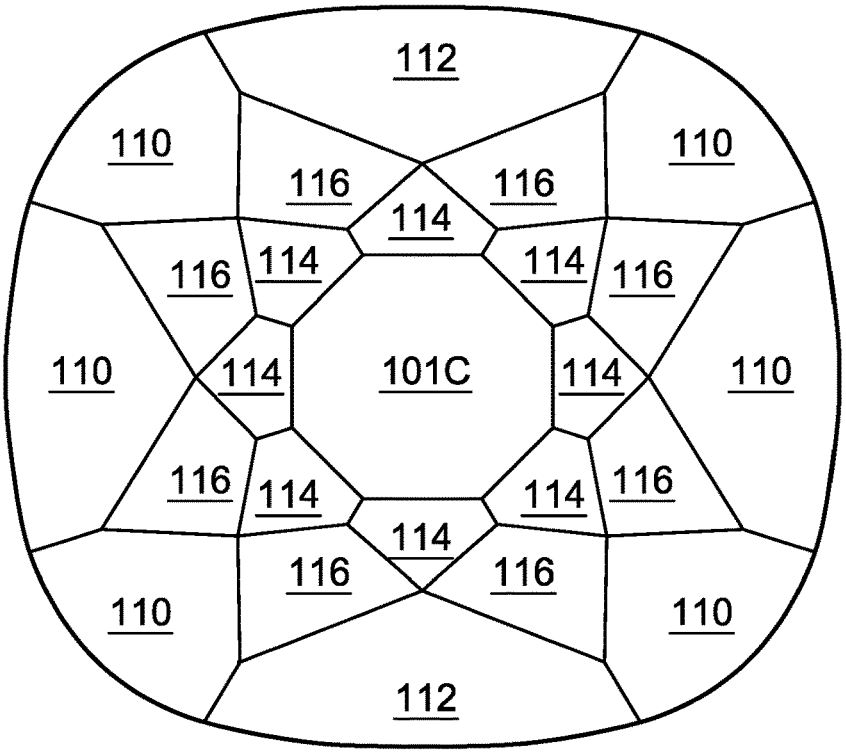
FIG. 5C illustrates a third step of the method of forming the crown of the gemstone of FIGS. 1A and 1B, according to some implementations of the present disclosure.

As shown in FIG. 5C, the next step is to carve out a pentagonal-shaped portions from the second preliminary table 101B and the third set of crown facets 108, to form a sixth set of crown facets 114 (e.g., a sixth temporary set of crown facets). The sixth set of crown facets 114 are formed at an angle of between about 15° and about 24°, and are generally disposed in a circular pattern on the crown 10 of the gemstone. The remaining portion of the second preliminary table 101B forms a third preliminary table 101C, which is generally horizontal. The remaining portions of the third set of crown facets 108 form a seventh set of crown facets 116 (e.g., a first final set of crown facets), which are thus disposed at the same angle as the third set of crown facets 108. After this step, the crown of the gemstone includes the third preliminary table 101C, the fourth set of crown facets 110, the fifth set of crown facets 112, the sixth set of crown facets 114, and the seventh set of crown facets 116. The seventh set of crown facets 116 corresponds to the major and minor lower intermediate crown facets of the final gemstone.

Figure 5D:
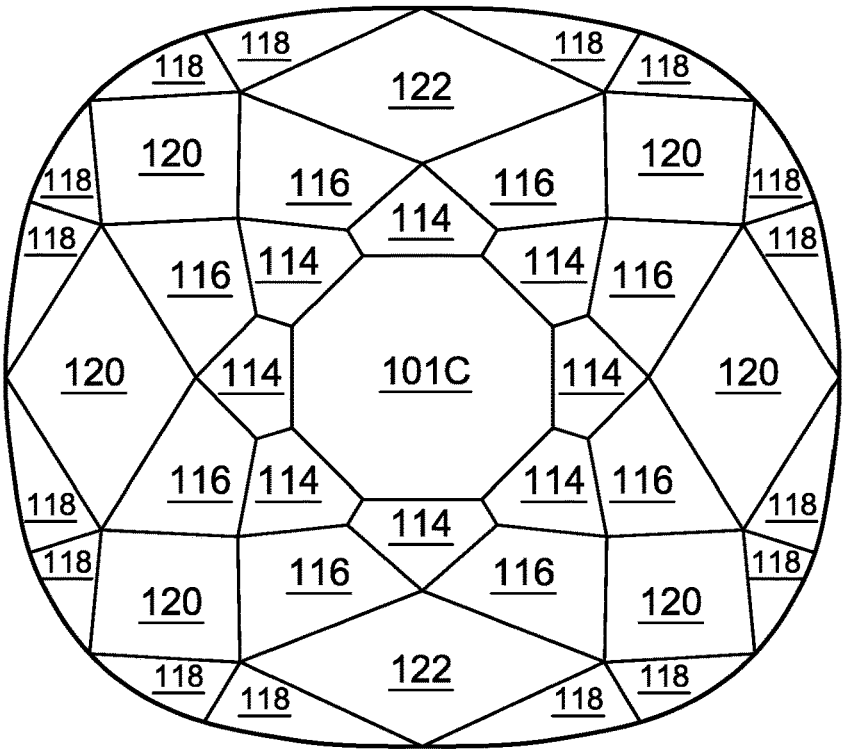
FIG. 5D illustrates a fourth step of the method of forming the crown of the gemstone of FIGS. 1A and 1B, according to some implementations of the present disclosure.

As shown in FIG. 5D, the following step is to carve out an eighth set of crown facets 118 (e.g., a second final set of crown facets) from portions of the fourth set of crown facets 110 and portions of the fifth set of crown facets 112. Some of the facets of the eighth set of crown facets 118 are disposed along the left and right sides of the major axis $A_1$, to the left and right of the minor axis $A_2$. The remaining facets of the eighth set of crown facets 118 are disposed along the top and bottom sides of the minor axis $A_2$, above and below the major axis $A_1$. The facets of the eighth set of crown facets 118 are triangular-shaped and abut the upper edge of the girdle. The eighth set of crown facets 118 are formed at an angle of between about 42.5° and about 57°.

After the eighth set of crown facets 118, two additional sets of crown facets are left behind from the remainder of the fourth set of crown facets 110 and the fifth set of crown facets 112. A ninth set of crown facets 120 (e.g., a third final set of crown facets) is formed from the remainder of the fourth set of crown facets 110, and is thus formed at the same angle as the fourth set of crown facets 110 and the first set of crown facets 104. A tenth set of crown facets 122 (e.g., a fourth final set of crown facets) is formed from the remainder of the fifth set of crown facets 112, and is thus formed at the same angle as the fifth set of crown facets 112 and the second set of crown facets 106.

After this step, the crown of the gemstone includes the third preliminary table 101C, the sixth set of crown facets 114, the seventh set of crown facets 116, the eighth set of crown facets 118, the ninth set of crown facets 120, and the tenth set of crown facets 122. The eighth set of crown facets 118 corresponds to the major, minor, and median upper girdle facets of the final gemstone. The ninth set of crown facets 120 corresponds to the central and outer major main crown of the final gemstone. The tenth set of crown facets 122 corresponds to the minor main crown facets of the final gemstone.

Figure 5E:
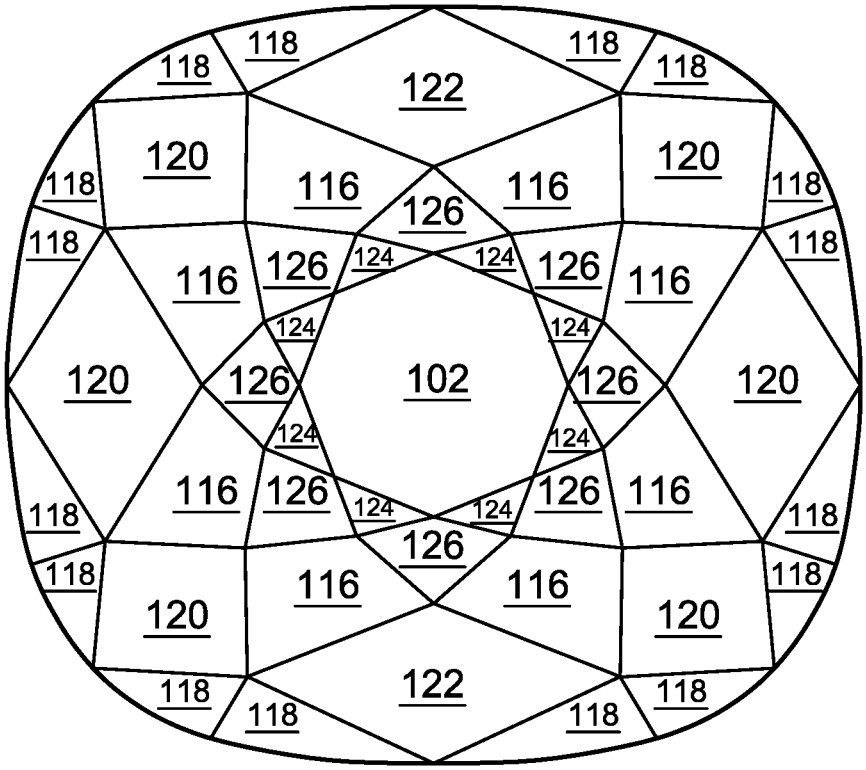
FIG. 5E illustrates a fifth step of the method of forming the crown of the gemstone of FIGS. 1A and 1B, according to some implementations of the present disclosure.

As shown in FIG. 5E, the final step in forming the crown of the gemstone is to carve out an eleventh set of crown facets 124 (e.g., a fifth final set of crown facets) from the sixth set of crown facets 114 and the third preliminary table 101C. The eleventh set of crown facets 124 are generally triangular-shaped, and are formed at an angle of between about 10° and about 17°. The remaining portions of the sixth set of crown facets 114 form a twelfth set of crown facets 126 (e.g., a sixth final set of crown facets), which are thus formed at the same angle as the sixth set of crown facets 114. The remaining portion of the third preliminary table 10C forms a table 102, this is generally horizontal (e.g., disposed at an angle of about) 0°.

As shown in FIG. 5E, the remaining set of facets on the crown (e.g., the first, second, third, fourth, fifth, and sixth final sets of crown facets) correspond to the facets on the finished crown in FIGS. 1A, 1B, and 2. The seventh set of crown facets 116 corresponds to the major and minor lower intermediate crown facets. The eighth set of crown facets 118 corresponds to the major, minor, and median upper girdle facets. The ninth set of crown facets 120 corresponds to the central and outer major main crown facets. The tenth set of crown facets 122 corresponds to the minor main crown facets. The eleventh set of crown facets 124 corresponds to the major and minor star facets.

Figure 6A:
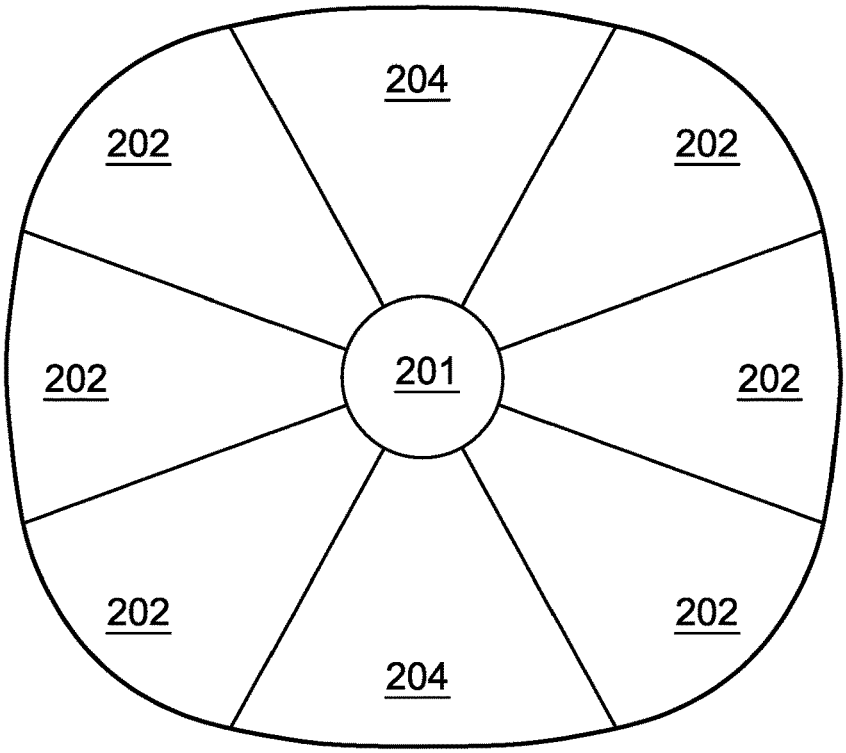
FIG. 6A illustrates a first step of a method of forming a pavilion of the gemstone of FIGS. 1A and 1B, according to some implementations of the present disclosure.

Referring now to FIGS. 6A-6D, the steps for forming the pavilion of the gemstone are illustrated. As used in relation to FIGS. 6A-6E, the major axis $A_1$ and the minor axis $A_2$ have the same orientations relative to the gemstone as gemstone 1 in FIGS. 2 and 3, but are not shown. Thus, in FIGS. 6A-6D, the major axis $A_1$ extends horizontally relative to the plane of the figures, while the minor axis $A_2$ extends vertically relative to the plane of the figures. As shown in FIG. 6A, the first step includes carving a first set of pavilion facets 202 (e.g., a first temporary set of pavilion facets) and a second set of pavilion facets 204 (e.g., a second temporary set of pavilion facets). In the illustrated implementation, a flat lower facet 201 is formed. However, in other implementations, a lower point can be formed. The first set of pavilion facets 202 are formed at an angle of between about 41° and about 45°. The facets of the first set of pavilion facets 202 are disposed along the left and right sides of the major axis $A_1$, to the left and right of the minor axis $A_2$. The second set of pavilion facets 204 are formed at an angle of between about 45° and about 49°. One of the second set of pavilion facets 204 is disposed along the top side of the minor axis $A_2$, above the major axis $A_1$. The other of the second set of pavilion facets 204 is disposed along the bottom side of the minor axis $A_2$, below the major axis $A_1$. The angle of the first and second sets of pavilion facets 202, 204 and the angles of subsequent pavilion facets formed in subsequent steps are measured relative to the horizontal plane that is defined by the preliminary tables 101A, 101B, 101C and the table 102 (shown in FIGS. 5A-5E), similar to how the angles of the facets of the completed pavilion were measured in FIGS. 1A and 1B. After this step, the pavilion of the gemstone includes the first set of pavilion facets 202 and the second set of pavilion facets 204.

Figure 6B:
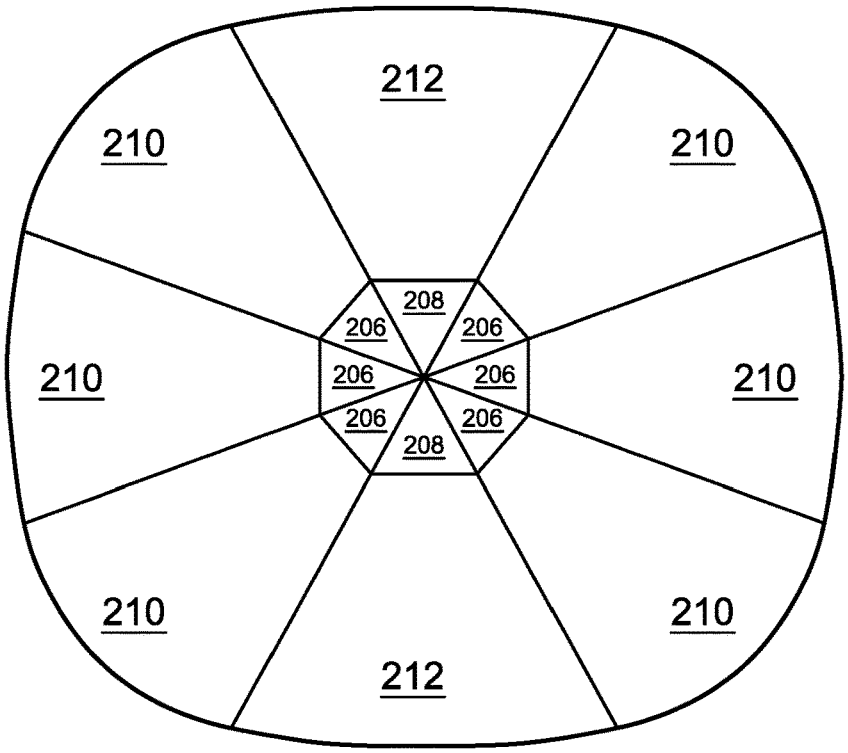
FIG. 6B illustrates a second step of the method of forming the pavilion of the gemstone of FIGS. 1A and 1B, according to some implementations of the present disclosure.

As shown in FIG. 6B, the next step in forming the pavilion is to carve a third set of pavilion facets 206 (e.g., a third temporary set of pavilion facets) from the first set of pavilion facets 202 and the flat lower facet 201, and a fourth set of pavilion facets 208 (e.g., a fourth temporary set of pavilion facets) from the second set of pavilion facets 204 and the flat lower facet 201. The third set of pavilion facets 206 is formed at angle of between about 32° and about 38°. The fourth set of pavilion facets 208 is formed at an angle of between about 36° and about 42°. The third set of pavilion facets 206 and the fourth set of pavilion facets 208 meet in the middle of the pavilion to form a lower point. The remaining portions of the first set of pavilion facets 202 form a fifth set of pavilion facets 210 (e.g., a fifth temporary set of pavilion facets), and are thus generally formed at the same angle as the first set of pavilion facets 202. The facets of the fifth set of pavilion facets 210 are disposed along the left and right sides of the major axis $A_1$, to the left and right of the minor axis $A_2$. The remaining portions of the second set of pavilion facets 204 form a sixth set of pavilion facets 212 (e.g., a sixth temporary set of pavilion facets), and are thus generally formed at the same angle as the second set of pavilion facets 204. One of the sixth set of pavilion facets 212 is disposed along the top side of the minor axis $A_2$, above the major axis $A_1$. The other of the sixth set of pavilion facets 212 is disposed along the bottom side of the minor axis $A_2$, below the major axis $A_1$. After this step, the pavilion of the gemstone includes the third set of pavilion facets 206, the fourth set of pavilion facets 208, the fifth set of pavilion facets 210, and the sixth set of pavilion facets 212.

Figure 6C:
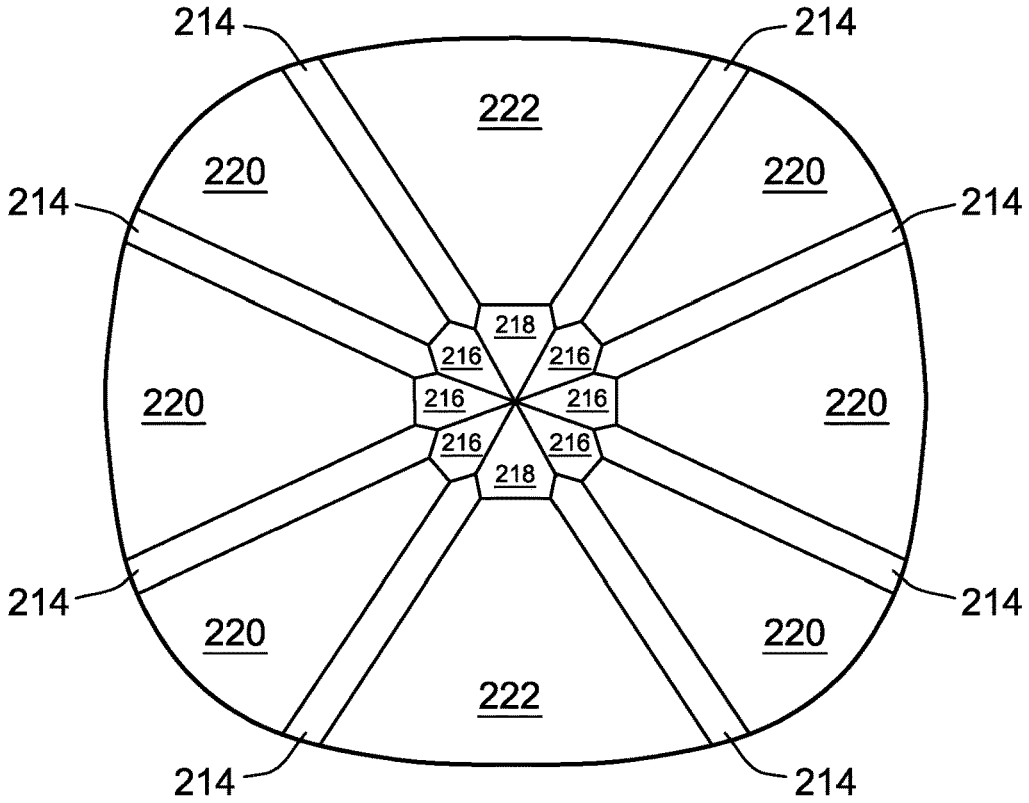
FIG. 6C illustrates a third step of the method of forming the pavilion of the gemstone of FIGS. 1A and 1B, according to some implementations of the present disclosure.

The next step is shown in FIG. 6C. Here, a seventh set of pavilion facets 214 (e.g., a seventh temporary set of pavilion facets) are carved into the pavilion. The seventh set of pavilion facets 214 are generally formed along (i) the shared edge between two of the third set of pavilion facets 206 and the fourth set of pavilion facets 208 (e.g., two of the third set 206; two of the fourth set 208; or one of the third set 206 and one of the fourth set 208), and (ii) the shared edge between two of the fifth set of pavilion facets 210 and the sixth set of pavilion facets 212 (e.g., two of the fifth set 210; two of the sixth set 212; or one of the fifth set 210 and one of the sixth set 212). The seventh set of pavilion facets 214 are formed at an angle of between about 40° and about 42°.

The seventh set of pavilion facets 214 are formed from portions of each of the third set of pavilion facets 206, the fourth set of pavilion facets 208, the fifth set of pavilion facets 210, and the sixth set of pavilion facets 212. The remainder of the third set of pavilion facets 206 form the eighth set of pavilion facets 216 (e.g., a first final set of pavilion facets). The facets of the eighth set of pavilion facets 216 are disposed along the left and right sides of the major axis $A_1$, to the left and right of the minor axis $A_2$. The eighth set of pavilion facets 216 are formed at the same angle as the third set of pavilion facets 206.

The remainder of the fourth set of pavilion facets 208 form the ninth set of pavilion facets 218 (e.g., a second final set of pavilion facets). One of the ninth set of pavilion facets 218 is disposed along the top side of the minor axis $A_2$, above the major axis $A_1$. The other of the ninth set of pavilion facets 218 is disposed along the bottom side of the minor axis $A_2$, below the major axis $A_1$. The ninth set of pavilion facets 218 are formed at the same angle as the fourth set of pavilion facets 208. The remainder of the fifth set of pavilion facets 210 form the tenth set of pavilion facets 220 (e.g., an eighth temporary set of pavilion facets). The facets of the tenth set of pavilion facets 220 are disposed along the left and right sides of the major axis $A_1$, to the left and right of the minor axis $A_2$. The tenth set of pavilion facets 220 are formed at the same angle as the fifth set of pavilion facets 210 and the first set of pavilion facets 202. The remainder of the sixth set of pavilion facets 212 form the eleventh set of pavilion facets 222 (e.g., a ninth temporary set of pavilion facets). One of the eleventh set of pavilion facets 222 is disposed along the top side of the minor axis $A_2$, above the major axis $A_1$. The other of the eleventh set of pavilion facets 222 is disposed along the bottom side of the minor axis $A_2$, below the major axis $A_1$. The eleventh set of pavilion facets 222 are formed at the same angle as the sixth set of pavilion facets 212 and the second set of pavilion facets 204.

After this step, the pavilion of the gemstone includes the seventh set of pavilion facets 214, the eighth set of pavilion facets 216, the ninth set of pavilion facets 218, the tenth set of pavilion facets 220, and the eleventh set of pavilion facets 222. The seventh set of pavilion facets 214 corresponds to the candle facets of the final gemstone. The eighth set of pavilion facets 216 corresponds to the major culet-adjacent facets of the final gemstone. The ninth set of pavilion facets 218 corresponds to the minor culet-adjacent facets of the final gemstone.

Figure 6D:
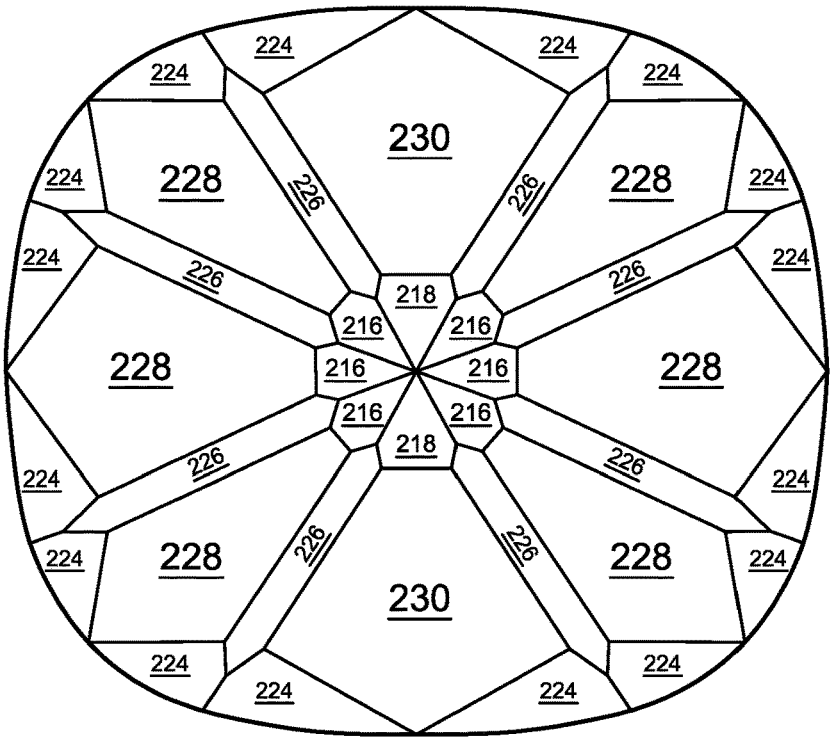
FIG. 6D illustrates a fourth step of the method of forming the pavilion of the gemstone of FIGS. 1A and 1B, according to some implementations of the present disclosure.

As shown in FIG. 6D, the final step in forming the pavilion of the gemstone is to carve a twelfth set of pavilion facets 224 (e.g., a third final set of pavilion facets) from portions of the seventh set of pavilion facets 214, the tenth set of pavilion facets 220, and the eleventh set of pavilion facets 222. Some of the facets of the twelfth set of pavilion facets 224 are disposed along the left and right sides of the major axis $A_1$, to the left and right of the minor axis $A_2$. The remainder of the facets of the twelfth set of pavilion facets 224 are disposed along the left and right sides of the major axis $A_1$, to the left and right of the minor axis $A_2$. The twelfth set of pavilion facets 224 are generally triangular-shaped with a flattened top (e.g., have four edges), and abut the lower edge of the girdle. The twelfth set of pavilion facets 224 are formed at an angle of between about 43° and about 57°.

The remainder of the seventh set of pavilion facets 214 form a thirteenth set of pavilion facets 225 (e.g., a fourth final set of pavilion facets), which are formed at the same angle as the seventh set of pavilion facets 214. The remainder of the tenth set of pavilion facets 220 form a fourteenth set of pavilion facets 228 (e.g., a fifth final set of pavilion facets), which are formed at the same angle as the tenth set of pavilion facets 220 and the fifth set of pavilion facets 210. The facets of the fourteenth set of pavilion facets 228 are disposed along the left and right sides of the major axis $A_1$, to the left and right of the minor axis $A_2$. The remainder of the eleventh set of pavilion facets 222 form a fifteenth set of pavilion facets 230 (e.g., a sixth final set of pavilion facets), which are formed at the same angle as the eleventh set of pavilion facets 222 and the sixth set of pavilion facets 212. One of the fifteenth set of pavilion facets 230 is disposed along the top side of the minor axis $A_2$, above the major axis $A_1$. The other of the fifteenth set of pavilion facets 230 is disposed along the bottom side of the minor axis $A_2$, below the major axis $A_1$.

As shown in FIG. 6D, the remaining set of facets on the pavilion (e.g., the first, second, third, fourth, fifth, and sixth final sets of pavilion facets) correspond to the facets on the finished pavilion in FIGS. 1A, 1B, and 3. The eighth set of pavilion facets 216 corresponds to the major culet-adjacent facets. The ninth set of pavilion facets 218 corresponds to the minor culet-adjacent facets. The twelfth set of pavilion facets 224 corresponds to the major, minor, and median lower girdle facets. The thirteenth set of pavilion facets 226 corresponds to the candle facets. The fourteenth set of pavilion facets 228 corresponds to the central and outer major main pavilion facets. The fifteenth set of pavilion facets 230 corresponds to the minor main pavilion facets.

Thus, a gemstone having a crown, a girdle, and a pavilion are thus formed. The crown and the pavilion comprise a number of sets of interlocking facets that share edges and vertices on the surface of the gemstone. Each of the sets of interlocking facets is disposed at a specific angle. The shape of the facets, the organization of the facets, and the angles that the facets are formed at on the surface of the gemstone result in a gemstone having an improved brilliance. The brilliance refers to the amount of light that enters the gemstone, and is internally reflected such that it exits out of the crown of the gemstone. The facets according to aspects of the present disclosure increase the amount of light reflecting off of the internal surfaces of the facets, thus increasing the brilliance of the gemstone.

While the present disclosure has been described with reference to one or more particular implementations, those skilled in the art will recognize that many changes may be made thereto without departing from the spirit and scope of the present disclosure. Each of these implementations and obvious variations thereof is contemplated as falling within the spirit and scope of the present disclosure. It is also contemplated that additional implementations according to aspects of the present disclosure may combine any number of features from any of the implementations described herein, such as, for example, in the alternative implementations described below.

ALTERNATIVE IMPLEMENTATIONS

Alternative Implementation 1. A gemstone comprising: a girdle defining a perimeter of the gemstone, the girdle having a cushion-shaped cross-section with a major axis and a minor axis, the major axis being larger than the minor axis; a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets, the plurality of main crown facets including a plurality of major main crown facets and a plurality of minor main crown facets, the plurality of major main crown facets being aligned along the major axis, the plurality of minor main crown facets being aligned along the minor axis; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets; and a pavilion forming a lower portion of the gemstone, a surface of the pavilion including: a plurality of culet-adjacent facets forming a lower point of the pavilion, the plurality of culet-adjacent facets including a plurality of major culet-adjacent facets and a plurality of minor culet-adjacent facets, the plurality of major culet-adjacent facets being aligned along the major axis, the plurality of minor culet-adjacent facets being aligned along the minor axis; a plurality of candle facets, a lower portion of each of the plurality of candle facets being disposed generally between two of the plurality of culet-adjacent facets; a plurality of main pavilion facets, each of the main pavilion facets being disposed between two of the plurality of candle facets, a lower edge of each of the plurality of main pavilion facets abutting an upper edge of one of the plurality of culet-adjacent facets, the plurality of main pavilion facets including a plurality of major main pavilion facets and a plurality of minor main pavilion facets, the plurality of major main pavilion facets being aligned along the major axis, the plurality of minor main pavilion facets being aligned along the minor axis; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween; and wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

Alternative Implementation 2. The gemstone of Alternative Implementation 1, wherein the gemstone has a table percentage between about 31.5% and about 35.5%.

Alternative Implementation 3. The gemstone of Alternative Implementation 1, wherein the gemstone has a top depth percentage between about 24.5% and about 28.5%.

Alternative Implementation 4. The gemstone of Alternative Implementation 1, wherein the gemstone has a bottom depth percentage between about 48.5% to about 52.5%.

Alternative Implementation 5. The gemstone of Alternative Implementation 1, wherein the gemstone has a total depth percentage between about 82.5% and about 86.5%.

Alternative Implementation 6. The gemstone of Alternative Implementation 1, wherein the gemstone has a girdle thickness percentage between about 4% and about 10%.

Alternative Implementation 7. The gemstone of Alternative Implementation 1, wherein a horizontal plane is defined by the table of the gemstone, and wherein each of the plurality of star facets is disposed at a first angle relative to the horizontal plane, each of the plurality of upper intermediate crown facets is disposed at a second angle relative to the horizontal plane, each of the plurality of lower intermediate crown facets is disposed at a third angle relative to the horizontal plane, each of the plurality of major main crown facets is disposed at a fourth angle relative to the horizontal plane, each of the plurality of minor main crown facets is disposed at a fifth angle relative to the horizontal plane, and each of the plurality of upper girdle facets is disposed at a sixth angle relative to the horizontal plane.

Alternative Implementation 8. The gemstone of Alternative Implementation 7, wherein first angle is between about 10° and about 17°.

Alternative Implementation 9. The gemstone of Alternative Implementation 7, wherein the second angle is between about 15° and about 24°.

Alternative Implementation 10. The gemstone of Alternative Implementation 7, wherein the third angle is between about 25° and about 35°.

Alternative Implementation 11. The gemstone of Alternative Implementation 7, wherein the fourth angle is between about 37° and about 45°.

Alternative Implementation 12. The gemstone of Alternative Implementation 7, wherein the fifth angle is between about 42° and about 49°.

Alternative Implementation 13. The gemstone of Alternative Implementation 7, wherein the sixth angle is between about 42.5° and about 57°.

Alternative Implementation 14. The gemstone of Alternative Implementation 1, wherein a horizontal plane is defined by the table of the gemstone, and wherein each of plurality of major culet-adjacent facets is disposed at a first angle relative to the horizontal plane, each of plurality of minor culet-adjacent facets is disposed at a second angle relative to the horizontal plane, each of plurality of candle facets is disposed at a third angle relative to the horizontal plane, each of plurality of major main pavilion facets is disposed at a fourth angle relative to the horizontal plane, each of the plurality of minor main pavilion facets is disposed at a fifth angle relative to the horizontal plane, and each of the plurality of lower girdle facets is disposed at a sixth angle relative to the horizontal plane.

Alternative Implementation 15. The gemstone of Alternative Implementation 14, wherein the first angle is between about 32° and about 38°.

Alternative Implementation 16. The gemstone of Alternative Implementation 14, wherein second angle is between about 36° and about 42°.

Alternative Implementation 17. The gemstone of Alternative Implementation 14, wherein the third angle is between about 40° and about 42°.

Alternative Implementation 18. The gemstone of Alternative Implementation 14, wherein the fourth angle is between about 41° and about 45°.

Alternative Implementation 19. The gemstone of Alternative Implementation 14, wherein the fifth angle is between about 45° and about 49°.

Alternative Implementation 20. The gemstone of Alternative Implementation 14, wherein the sixth angle is between about 43° and about 57°.

Alternative Implementation 21. The gemstone of Alternative Implementation 1, wherein the cross-section of the gemstone is a rectangular shape with rounded corners.

Alternative Implementation 22. The gemstone of Alternative Implementation 1, wherein the cross-section of the gemstone is a square shape with rounded corners.

Alternative Implementation 23. A gemstone comprising: a girdle defining a perimeter of the gemstone, the girdle having a cushion-shaped cross-section; and a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets.

Alternative Implementation 24. A gemstone comprising: a girdle defining a perimeter of the gemstone, the girdle having a cushion-shaped cross-section; and a pavilion forming a lower portion of the gemstone, a surface of the pavilion including: a plurality of culet-adjacent facets forming a lower point of the pavilion; a plurality of candle facets, a lower portion of each of the plurality of candle facets being disposed generally between two of the plurality of culet-adjacent facets; a plurality of main pavilion facets, each of the plurality of main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween.

Alternative Implementation 25. A gemstone comprising: a girdle defining a perimeter of the gemstone, the girdle having a cushion-shaped cross-section; a crown forming an upper portion of the gemstone, a surface of the crown including: a table forming a generally horizontal upper surface of the crown, the table having a generally octagonal shape; a plurality of star facets disposed adjacent to the table, each of the plurality of star facets being triangle-shaped; a plurality of upper intermediate crown facets disposed adjacent to the plurality of star facets, each of the plurality of upper intermediate crown facets being kite-shaped; a plurality of lower intermediate crown facets disposed adjacent to the plurality of upper intermediate crown facets, each of the plurality of lower intermediate crown facets being kite-shaped; a plurality of main crown facets disposed adjacent to the plurality of lower intermediate crown facets, each of the plurality of main crown facets being kite-shaped; and a plurality of upper girdle facets disposed adjacent to the plurality of main crown facets, each of the plurality of upper girdle facets being triangle-shaped; and a pavilion forming a lower portion of the gemstone, a surface of the pavilion including: a plurality of culet-adjacent facets forming a lower point of the pavilion, each of the plurality of culet-adjacent facets having a generally pentagonal shape; a plurality of candle facets disposed adjacent to the plurality of culet-adjacent facets, each of the plurality of candle facets having six edges; a plurality of main pavilion facets, each of the main pavilion facets being disposed between two of the plurality of candle facets and being pentagon-shaped; and a plurality of lower girdle facets formed in pairs of adjacent lower girdle facets, each pair of adjacent lower girdle facets being disposed generally between two of the plurality of main pavilion facets, each lower girdle facet having four edges; and wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

Alternative Implementation 26. A gemstone comprising: a crown forming an upper portion of the gemstone; a pavilion forming a lower portion of the gemstone; and a girdle positioned between the crown and the pavilion and encircling the gemstone, the girdle having a cushion-shaped cross-section with a major axis and a minor axis, the major axis being larger than the minor axis, wherein the gemstone has a top depth percentage between about 15% and about 35%, and a bottom depth percentage between about 40% and about 60%.

Alternative Implementation 27. The gemstone of Alternative Implementation 26, wherein the gemstone has a total depth percentage between about 75% and about 95%.

Alternative Implementation 28. The gemstone of Alternative Implementation 26, wherein the gemstone has a table percentage between about 25% and about 45%.

Alternative Implementation 29. The gemstone of Alternative Implementation 26, wherein the gemstone has a girdle thickness percentage between about 2% and about 12%.

Alternative Implementation 30. A gemstone comprising: a crown forming an upper portion of the gemstone; a pavilion forming a lower portion of the gemstone; and a girdle positioned between the crown and the pavilion and encircling the gemstone, the girdle having a cushion-shaped cross-section with a major axis and a minor axis, the major axis being larger than the minor axis, wherein the gemstone has a total depth percentage between about 75% and about 95%.

Alternative Implementation 31. A gemstone comprising: a crown forming an upper portion of the gemstone, a surface of the crown including a first plurality of facets, each of the first plurality of facets being disposed at an angle between about 5° and about 60° relative to an upper surface of the gemstone; and a pavilion forming a lower portion of the gemstone, a surface of the pavilion including a second plurality of facets, each of the second plurality of facets being disposed at an angle between about 25° and about 60° relative to the upper surface of the gemstone.

Alternative Implementation 32. A method of forming a crown of a gemstone, comprising: forming a generally horizontal upper surface on an upper portion of the gemstone; forming a first temporary set of crown facets and a second temporary set of crown facets on the upper portion of the gemstone, the first temporary set of crown facets being formed at an angle of between about 37° and about 45° relative to the first preliminary table, the second temporary set of crown facets being formed at an angle of between about 42° and about 49° relative to the first preliminary table; forming a third temporary set of crown facets on the upper portion of the gemstone from portions of the generally horizontal upper surface, the first temporary set of crown facets, and the second temporary set of crown facets, the third temporary set of crown facets being formed at an angle of between about 27° and about 35.5° relative to the generally horizontal upper surface, a remainder of the first temporary set of crown facets forming a fourth temporary set of crown facets, a remainder of the second temporary set of crown facets forming a fifth temporary set of crown facets; forming a sixth temporary set of crown facets on the upper portion of the gemstone from portions of the generally horizontal upper surface and the third temporary set of crown facets, the sixth temporary set of crown facets being formed at an angle of between about 15° and about 24° relative to the generally horizontal upper surface, a remainder of the third temporary set of crown facets forming a first final set of crown facets; forming a second final set of crown facets on the upper portion of the gemstone from portions of the fourth temporary set of crown facets and the fifth temporary set of crown facets, the second final set of crown facets being formed at an angle of between about 42.5° and about 57° relative to the generally horizontal upper surface, a remainder of the fourth temporary set of crown facets forming a third final set of crown facets, a remainder of the fifth temporary set of crown facets forming a fourth final set of crown facets; and forming a fifth final set of crown facets on the upper portion of the gemstone from portions of the generally horizontal surface and the sixth temporary set of crown facets, the fifth final set of crown facets being formed at an angle of between about 10° and about 17° relative to the generally horizontal upper surface, a remainder of the sixth temporary set of crown facets forming a sixth final set of crown facets, such that the upper portion of the gemstone is formed from the first, second, third, fourth, fifth, and sixth final sets of crown facets.

Alternative Implementation 33. A method of forming a pavilion of a gemstone having a horizontal upper surface, comprising: forming a first temporary set of pavilion facets, a second temporary set of pavilion facets, and a flat lower facet on a lower portion of the gemstone, the first temporary set of pavilion facets being formed at an angle of between about 41° and about 45° relative to the horizontal upper surface, the second temporary set of pavilion facets being formed at an angle of between about 45° and about 49° relative to the horizontal upper surface; forming a third temporary set of pavilion facets and a fourth temporary set of pavilion facets on the lower portion of the gemstone, the third temporary set of pavilion facets being formed from the first temporary set of pavilion facets and the flat lower facet, and being formed at an angle of between about 32° and about 38° relative to the horizontal upper surface, the fourth temporary set of pavilion facets being formed from the second temporary set of pavilion facets and the flat lower facet, and being formed at an angle of between about 36° and about 42° relative to the horizontal upper surface, a remainder of the first temporary set of pavilion facets forming a fifth temporary set of pavilion facets; a remainder of the second temporary set of pavilion facets forming a sixth temporary set of pavilion facets; forming a seventh temporary set of pavilion facets on the lower portion of the gemstone from portions of third temporary set of pavilion facets, the fourth temporary set of pavilion facets, the fifth temporary set of pavilion facets, and the sixth temporary set of pavilion facets, the seventh set of temporary pavilion facets being formed at an angle of between about 40° and about 42° relative to the horizontal upper surface, a remainder of the third temporary set of pavilion facets forming a first final set of pavilion facets, a remainder of the fourth temporary set of pavilion facets forming an second final set of pavilion facets, a remainder of the fifth temporary set of pavilion facets forming an eighth temporary set of pavilion facets, a remainder of the sixth temporary set of pavilion facets forming a ninth temporary set of pavilion facets; and forming a third final set of pavilion facets on the lower portion of the gemstone from the seventh temporary set of pavilion facets, the eighth temporary set of pavilion facets, and the ninth temporary set of pavilion facets, the third final set of pavilion facets being formed at an angle of between about 43° and about 57° relative to the horizontal upper surface, a remainder of the seventh temporary set of pavilion facets forming a fourth final set of pavilion facets, a remainder of the eighth temporary set of pavilion facets forming a fifth final set of pavilion facets, a remainder of the ninth temporary set of pavilion facets forming a sixth final set of pavilion facets, such that the lower portion of the gemstone is formed from the first, second, third, fourth, fifth, and sixth final sets of pavilion facets.

Alternative Implementation 34. The method of Alternative Implementation 32 or Alternative Implementation 33, further comprising forming a girdle defining a perimeter of the gemstone, the girdle having a cushion-shaped cross-section with a major axis and a minor axis, the major axis being larger than the minor axis.

Alternative Implementation 35. A gemstone comprising: a girdle defining a perimeter of the gemstone; a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets, the plurality of main crown facets including a plurality of major main crown facets and a plurality of minor main crown facets, the plurality of major main crown facets being aligned along the major axis, the plurality of minor main crown facets being aligned along the minor axis; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets; and a pavilion forming a lower portion of the gemstone, a surface of the pavilion including: a plurality of culet-adjacent facets forming a lower point of the pavilion, the plurality of culet-adjacent facets including a plurality of major culet-adjacent facets and a plurality of minor culet-adjacent facets, the plurality of major culet-adjacent facets being aligned along the major axis, the plurality of minor culet-adjacent facets being aligned along the minor axis; a plurality of candle facets, a lower portion of each of the plurality of candle facets being disposed generally between two of the plurality of culet-adjacent facets; a plurality of main pavilion facets, each of the main pavilion facets being disposed between two of the plurality of candle facets, a lower edge of each of the plurality of main pavilion facets abutting an upper edge of one of the plurality of culet-adjacent facets, the plurality of main pavilion facets including a plurality of major main pavilion facets and a plurality of minor main pavilion facets, the plurality of major main pavilion facets being aligned along the major axis, the plurality of minor main pavilion facets being aligned along the minor axis; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween; wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

It is expressly contemplated that one or more elements or any portion(s) thereof from any of the Alternative Implementations 1-35 above can be combined with one or more elements or any portion(s) thereof from any of the other ones of the Alternative Implementations 1-35 to form one or more additional alternative implementations of the present disclosure.

What is claimed is:

1. A gemstone comprising:

a girdle defining a perimeter of the gemstone, the girdle having a cushion-shaped cross-section with a major axis and a minor axis, the major axis being larger than the minor axis;

a crown forming an upper portion of the gemstone, a surface of the crown including:

a table forming a generally horizontal upper surface of the crown;

a plurality of star facets, each of the plurality of star facets being disposed adjacent to and abutting an edge of the table;

a plurality of upper intermediate crown facets, each of the plurality of upper intermediate crown facets being disposed generally between two of the plurality of star facets, an upper vertex of each of the plurality of upper intermediate crown facets abutting a vertex of the table, the plurality of upper intermediate crown facets including major upper intermediate crown facets, minor upper intermediate crown facets, and median upper intermediate crown facets, wherein one of (i) the major upper intermediate crown facets, (ii) the minor upper intermediate crown facets, and (iii) the median upper intermediate crown facets, have a different general shape than the remaining upper intermediate crown facets;

a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets;

a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets, the plurality of main crown facets including a plurality of central major main crown facets and a plurality of minor main crown facets, the plurality of central major main crown facets being aligned along the major axis, the plurality of minor main crown facets being aligned along the minor axis; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets; and a pavilion forming a lower portion of the gemstone, a surface of the pavilion including:

a plurality of culet-adjacent facets forming a lower point of the pavilion, the plurality of culet-adjacent facets including a plurality of major culet-adjacent facets and a plurality of minor culet-adjacent facets, the plurality of major culet-adjacent facets being aligned along the major axis, the plurality of minor culet-adjacent facets being aligned along the minor axis;

a plurality of candle facets, a lower portion of each of the plurality of candle facets being disposed generally between two of the plurality of culet-adjacent facets;

a plurality of main pavilion facets, each of the main pavilion facets being disposed between two of the plurality of candle facets, a lower edge of each of the plurality of main pavilion facets abutting an upper edge of one of the plurality of culet-adjacent facets, the plurality of main pavilion facets including a plurality of major main pavilion facets and a plurality of minor main pavilion facets, the plurality of major main pavilion facets being aligned along the major axis, the plurality of minor main pavilion facets being aligned along the minor axis; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween;

wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle, and wherein the gemstone has a table percentage between about 31.5 percent and about 45 percent, and wherein the gemstone has a top depth percentage between about 24.5 percent and about 35 percent.

2. The gemstone of claim 1, wherein each of the facets of the crown is disposed at an angle between about 5° and about 60° relative to the table of the crown, wherein the major upper intermediate crown facets are aligned along the major axis, and the minor upper intermediate crown facets are aligned along the minor axis.

3. The gemstone of claim 1, wherein each of the plurality of central major main crown facets is disposed at an angle of between about 37° and about 45° relative to the table of the crown, and wherein each of the plurality of minor main crown facets is disposed at an angle of between about 42° and about 49° relative to the table of the crown.

4. The gemstone of claim 1, wherein the cross-section of the girdle is a rectangular shape with rounded corners, or a square shape with rounded corners.

5. The gemstone of claim 1, wherein each of the plurality of culet-adjacent facets is pentagon-shaped, each of the plurality of candle facets has six edges, each of the plurality of main pavilion facets is pentagon-shaped, and each of the plurality of lower girdle facet has four edges.

6. The gemstone of claim 1, wherein each of the facets of the pavilion is disposed at an angle between about 25° and about 60° relative to the table of the crown.

7. The gemstone of claim 1, wherein each of the major culet-adjacent facets is disposed at an angle of between about 32° and about 38° relative to the table of the crown, and wherein each of the minor culet-adjacent facets is disposed at an angle of between about 36° and about 42° relative to the table of the crown.

8. The gemstone of claim 1, wherein each of the major main pavilion facets is disposed at an angle of between about 41° and about 45° relative to the table of the crown, and wherein each of the minor main pavilion facets is disposed at an angle of between about 45° and about 49° relative to the table of the crown.

9. The gemstone of claim 1, wherein the gemstone has a girdle thickness percentage between about 2% and about 12%.

10. The gemstone of claim 1, wherein the plurality of lower intermediate crown facets includes major lower intermediate crown facets and minor lower intermediate crown facets, wherein the major lower intermediate crown facets are aligned along the major axis, wherein the minor lower intermediate crown facets are aligned along the minor axis, and wherein the major lower intermediate crown facets have a different general shape than the minor lower intermediate crown facets.

11. The gemstone of claim 10, wherein the plurality of main crown facets further includes a plurality of outer major main crown facets, wherein each of (i) the central major main crown facets, (ii) the outer major main crown facets, and (iii) the minor main crown facets, has a different general shape.

12. The gemstone of claim 11, wherein the upper vertex of each of the central major main crown facets abuts (i) a lower vertex of an adjacent one of the major upper intermediate crown facets, and (ii) a lateral vertex of each of two adjacent ones of the major lower intermediate crown facets.

13. The gemstone of claim 12, wherein the upper vertex of each of the outer major main crown facets abuts: (i) a lower vertex of an adjacent one of the median upper intermediate crown facets, (ii) a lateral vertex of an adjacent one of the major lower intermediate crown facets, and (iii) a lateral vertex of an adjacent one of the minor lower intermediate crown facets.

14. The gemstone of claim 13, wherein the upper vertex of each of the minor main crown facets abuts: (i) a lower vertex of an adjacent one of the minor upper intermediate crown facets, and (ii) a lateral vertex of each of two adjacent ones of the minor lower intermediate crown facets.

15. The gemstone of claim 1, wherein lateral vertices of each adjacent pair of the candle facets abut lateral vertices of: (i) the central major main pavilion facets, (ii) the outer major main pavilion facets, or (iii) the minor main pavilion facets.

16. The gemstone of claim 15, wherein two lower vertices of the central major main pavilion facets and two lower vertices of the outer major main pavilion facets each abut: (i) a lateral vertex of an adjacent candle facet, and (ii) upper vertices of a corresponding major culet-adjacent facet.

17. The gemstone of claim 15, wherein two lower vertices of the minor main pavilion facets each abut: (i) a lateral vertex of an adjacent candle facet, and (ii) upper vertices of a corresponding minor cutlet-adjacent facet.

18. The gemstone of claim 1, wherein the table percentage is about 33.5 percent.

19. The gemstone of claim 1, wherein the top depth percentage is between about 24.5 percent and about 30 percent.

20. The gemstone of claim 1, wherein the top depth percentage is about 26.2 percent.

21. The gemstone of claim 1, wherein the gemstone has a total depth percentage between about 75 percent and about 95 percent.

22. The gemstone of claim 1, wherein the gemstone has a total depth percentage between about 82.5 percent and about 86.5 percent.

23. The gemstone of claim 1, wherein the gemstone has a total depth percentage of about 84.5 percent.

24. The gemstone of claim 1, wherein the gemstone has a girdle thickness percentage between about 4% and about 10%.

25. The gemstone of claim 1, wherein the gemstone has a girdle thickness percentage between about 6% and about 8%.

26. The gemstone of claim 1, wherein a combined area of the culet facets is less than an area of the table.

* * * * *